US012139930B2

(12) United States Patent
Peterson et al.

(10) Patent No.: US 12,139,930 B2
(45) **Date of Patent: *Nov. 12, 2024**

(54) POOL COVER ASSEMBLY AND SYSTEMS

(71) Applicant: Latham Pool Products, Inc., Latham, NY (US)

(72) Inventors: John Thomas Carl Peterson, Murray, UT (US); Mathew Dalton, Saratoga Springs, UT (US)

(73) Assignee: Latham Pool Products, Inc., Latham, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/143,426

(22) Filed: May 4, 2023

(65) Prior Publication Data

US 2023/0383562 A1 Nov. 30, 2023

Related U.S. Application Data

(63) Continuation of application No. 17/901,884, filed on Sep. 2, 2022, now Pat. No. 11,680,419, which is a (Continued)

(51) Int. Cl.
*E04H 4/10* (2006.01)

(52) U.S. Cl.
CPC ..... *E04H 4/101* (2013.01); *E04H 4/108* (2013.01)

(58) Field of Classification Search
CPC ..... E04H 4/101; E04H 4/108; E04H 4/141; E03C 1/1222; E03C 1/182; E03C 1/284
(Continued)

(56) References Cited

U.S. PATENT DOCUMENTS 7,114,297 B2 10/2006 Mathis et al.
7,861,471 B2 1/2011 Smith
(Continued)

FOREIGN PATENT DOCUMENTS

FR 2551792 3/1985

OTHER PUBLICATIONS

"The Eclipse™ Automatic Safety Pool Cover Under Track System Installation Manual", Coverstar, Feb. 8, 2016, 21 pages.
(Continued)

*Primary Examiner* — Lori L Baker
(74) *Attorney, Agent, or Firm* — Kilpatrick Townsend & Stockton LLP

(57) ABSTRACT

A pool cover assembly includes a first encapsulation member defining a first side of a pool cover encapsulation, the first encapsulation member comprising a first mating feature. The pool cover assembly further includes a second encapsulation member defining a second side of the pool cover encapsulation, the second encapsulation member comprising a second mating feature. And the pool cover assembly further includes a corner endcap member comprising a third mating feature and a fourth mating feature. The first encapsulation member is coupleable to the corner endcap by the first mating feature and the third mating feature, and the second encapsulation member is coupleable to the corner endcap by the second mating feature and the fourth mating feature. The corner endcap member couples with the first encapsulation member and the second encapsulation member to form a corner of the pool cover encapsulation.

33 Claims, 17 Drawing Sheets

Related U.S. Application Data continuation of application No. 17/065,059, filed on Oct. 7, 2020, now Pat. No. 11,454,040.

(60) Provisional application No. 62/912,529, filed on Oct. 8, 2019.

(58) Field of Classification Search
USPC ..... 4/502, 503, 504, 500; 285/125.1, 122.1
See application file for complete search history.

(56) References Cited

U.S. PATENT DOCUMENTS

| | | | | |
|---|---|---|---|---|
| 8,205,319 | B1 * | 6/2012 | Dunn | E04H 4/142 29/525.01 |
| 8,403,723 | B1 * | 3/2013 | Haner | A63B 67/007 446/124 |
| 10,097,133 | B2 | 10/2018 | Aliabadi et al. | |
| 11,454,040 | B2 * | 9/2022 | Peterson | E04H 4/101 |
| 2021/0102392 | A1 | 4/2021 | Peterson et al. | |

OTHER PUBLICATIONS

U.S. Appl. No. 17/065,059 , "Non-Final Office Action", Jan. 26, 2022, 10 pages.
U.S. Appl. No. 17/065,059 , "Notice of Allowance", May 26, 2022, 7 pages.
U.S. Appl. No. 17/901,884 , "Non-Final Office Action", Mar. 23, 2023, 8 pages.
U.S. Appl. No. 17/901,884 , "Notice of Allowance", Apr. 28, 2023, 8 pages.
EP20200639.1 , "Extended European Search Report", Feb. 10, 2021, 9 pages.
EP20200639.1 , "Office Action", Nov. 9, 2022, 7 pages.
MX/A/2020/010581 , "Office Action", Jan. 5, 2021.
Israel Application No. IL277843 ,"Office Action", Aug. 31, 2023, 6 pages.

* cited by examiner

POOL COVER ASSEMBLY AND SYSTEMS

CROSS REFERENCE TO RELATED APPLICATION

This is a continuation of U.S. application Ser. No. 17/901,884, filed on Sep. 2, 2022, and entitled "Pool Cover Assembly and Systems," which is a continuation of U.S. application Ser. No. 17/065,059, filed on Oct. 7, 2020, and entitled "Pool Cover Assembly and Systems," and patented on Sep. 27, 2022 as U.S. Pat. No. 11,454,040, which claims the benefit of U.S. Provisional Application No. 62/912,529, filed Oct. 8, 2019, and entitled "Pool and Pool Cover Assembly and Systems," the entire contents of all of which are incorporated herein in their entireties by reference.

FIELD OF THE INVENTION

This application relates generally to pool assemblies, and more particularly, although not necessarily exclusively, to pool cover assemblies that include encapsulation connection systems for the encapsulation pieces of the pool cover assemblies.

BACKGROUND OF THE INVENTION

Automated swimming pool covers can be installed on various types of pools, including fiberglass pools, gunite or concrete pools, and vinyl liner pools. An automated pool cover system may use a motor to cause the pool cover to extend and retract over the pool to cover and uncover the pool. The cover system may include a track that runs the full length of the pool on both sides. The track may be formed as part of an encapsulation that extends around the outer edges of the pool and may include a coping.

Conventionally, the encapsulation for each edge of the pool is shipped as a single piece, and each piece of encapsulation is secured to form the corners when constructing the pool. In some instances, these single pieces of encapsulation may be shipped at lengths that incur additional shipping fees or shipping challenges. Shipping objects of this size has increased costs and difficulties due to handling and storing of packages of this size, has an increased risk of damage to the encapsulation pieces, and has an increased risk of injury to individuals moving the encapsulation pieces.

The forming of the corners between the encapsulation pieces is often a labor and time intensive process that requires detailed cutting and forming of a radius corner and the ends of the encapsulation pieces to connect the encapsulation pieces. The encapsulation pieces and radius corner then still must be glued or welded together to form the corner

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

Certain embodiments and features of the present disclosure relate to pool cover assemblies for pools that may provide for simpler and quicker connection of the various elements of the pool cover assemblies during the construction of the pools. In some embodiments, the pool cover assembly includes a pool cover encapsulation formed of multiple encapsulation members that are interconnected to form corners of the pool cover encapsulation.

A corner connection assembly may be used to quickly form the corners of the pool cover encapsulation. For example, the corner connection assembly may include the encapsulation members, a corner endcap member, a coping clip, and/or a liner corner plate. To form the corner of the pool cover assembly, the encapsulation members may be attached to the corner endcap member at a 90° angle. The coping clip may be used if the encapsulation members have coping portions to secure two coping portions together. The liner corner plate may be inserted into the encapsulation members to adjust the radius size or angle of the corner of the pool cover assembly. The connections between the encapsulation members, the corner endcap, the coping clip, and the liner corner plate may be achieved without the use of glue, welding, or fasteners.

According to aspects of the present disclosure, extended length elements of the pool cover assembly, for example the encapsulation members that may define the edges of the pool, the leading edge bar, vault lids, auto cover tracks, etc., may be formed by coupling together separate portions (or lengths) of material using a splice member. Various types of a splice members may be used to couple the separate portions of the extended length elements. The splice member may include, but is not limited to, a coping clip splice member, a snap button splice member, an expandable compression-fit splice member, a key-hole interlocking splice member, or other suitable splice members.

BRIEF DESCRIPTION OF THE DRAWINGS

A further understanding of the nature and advantages of various embodiments may be realized by reference to the following figures. In the appended figures, similar components or features may have the same reference label.

DETAILED DESCRIPTION

Figure 1:
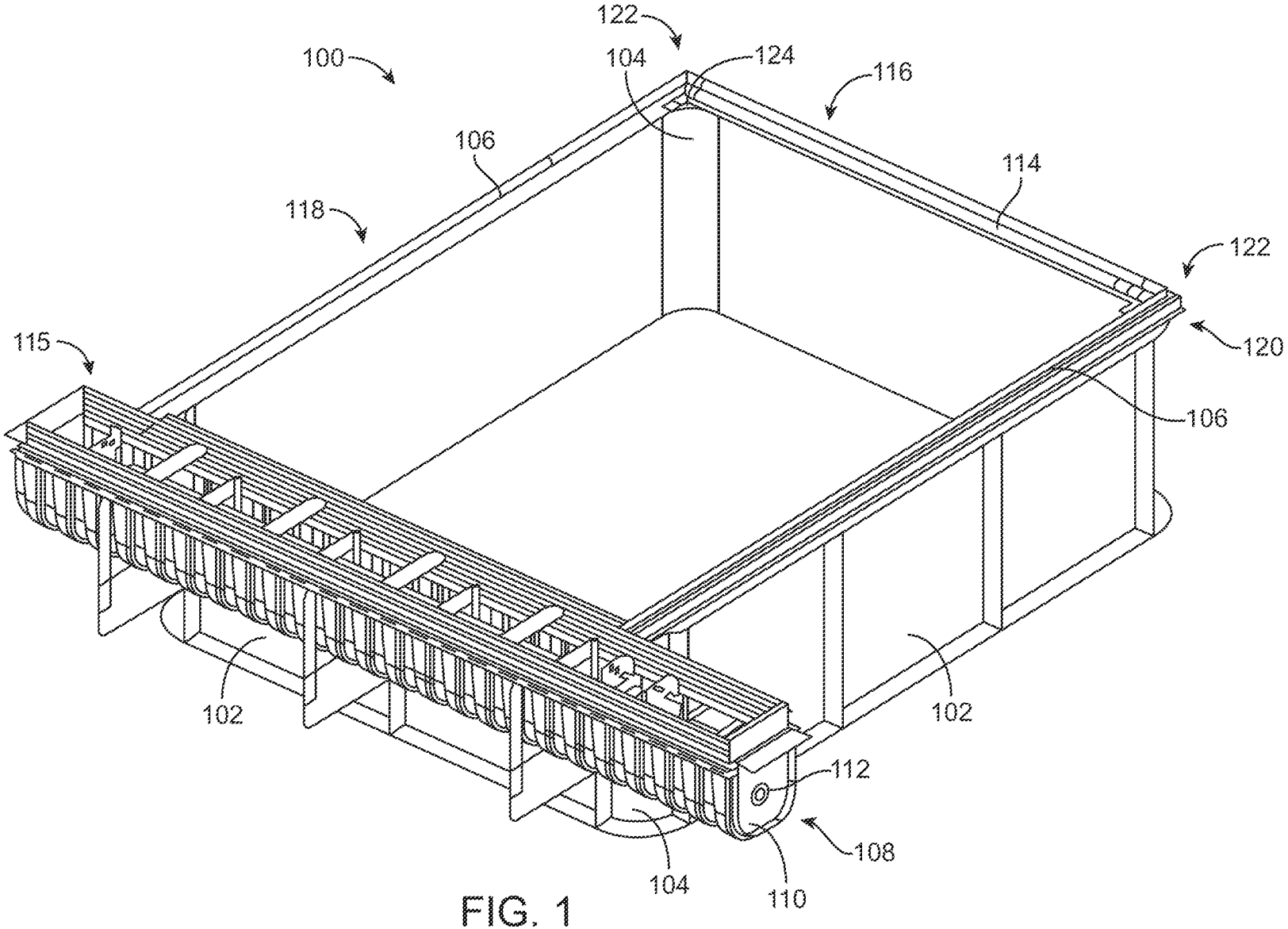
FIG. 1 is a perspective view of a pool according to certain embodiments of the present disclosure.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "upper," "lower," "down," "top," "left," "right," "bottom," "among others, are intended to refer to the orientation as illustrated and described in the figure (or figures) to which the components and directions are referencing.

Certain embodiments and features of the present disclosure relate to pool assemblies, including pool cover assemblies and pool cover systems for pools that may provide for simpler and quicker connection of the various elements of the pool cover assemblies during the construction of the pools. In some embodiments, the pool cover assembly includes a pool cover encapsulation formed of multiple edging members, which may be referred to herein as encapsulation members, that are interconnected to define edges of the pool and to form corners of the pool cover encapsulation. The pool cover encapsulation may extends along at least three sides of the pool. It should be noted that pools that do not include a pool cover assembly may include the same or similar encapsulation members that interconnect to form the edges of the pool.

Forming corners of the pool cover assemblies has been a difficult and time consuming task due to the size of the encapsulation members and the need to cut, glue, and miter the encapsulation members to form a corner. A corner connection assembly may be used to quickly form the pool cover assembly. For example, the corner connection assembly may include the encapsulation members and a corner connector, which may be referred to herein as a corner endcap member. In some embodiments, the corner connection assembly may also include a coping clip and/or a corner forming piece, which may be referred to herein as a liner corner plate.

To form the corner of the pool cover assembly, the encapsulation members may be attached to the corner endcap member at a 90° angle. A coping clip may be used if the encapsulation members have coping portions to secure two coping portions together. The liner corner plate may be inserted into the encapsulation members to adjust the radius size or angle of the corner of the pool cover assembly. The connections between the encapsulation members, the corner endcap, the coping clip, and the liner corner plate may be achieved without the use of glue, welding, or fasteners. For example, these parts may be secured together via a friction-fit engagement, a snap-fit engagement, a snap button, etc. This allows for quick and easy formation of the corner of the pool cover assembly as well as removal of any of the elements if repairs or replacement is needed.

The encapsulation members, which when coupled together define the sides or edges of the pool cover assembly (and also the edges of a pool itself), as well as other extended length elements of the pool cover assembly, may be formed by (and optionally later broken down into) separate portions or pieces and coupled together using a splice member. This is particularly beneficial because shipping extended length elements has become expensive, difficult, and risky. For example, an encapsulation member that defines a side of a pool cover assembly may be formed by coupling together a plurality of encapsulation portions to define a desired length of the encapsulation member. Typically, objects having a dimension that is greater than 8 feet begin to incur "over length" shipping charges with increased "over length" shipping charges being incurred at greater incremental lengths.

By coupling together two or more encapsulation portions to form the encapsulation member, the elements forming the pool cover encapsulation may be of a length that does not require oversize shipping. Various types of a splice member may be used to couple the separate portions of the extended length elements. The splice member may include, but is not limited to, a coping clip splice member, a snap button splice member, an expandable compression-fit splice member, and a key-hole interlocking splice member.

According to certain embodiments of the present disclosure, as shown in FIG. 1, a pool 100 may include a plurality of wall panels 102, a plurality of corner panels 104, and a pool cover assembly 108. The pool cover assembly 108 may include a plurality of encapsulation members 106 that together define the sides and corners of the pool. The pool 100 may be a vinyl liner pool, a fiberglass pool, or a gunite pool and may be formed in-ground or above-ground.

The various elements of the pool 100 described below may be formed of materials including but not limited to aluminum, steel, stainless steel, concrete, stone, plastic, ceramic, fiberglass, aramid fibers, polymer, polycarbonate, polypropylene, other metallic materials, composite materials, or other similar materials. Additionally, each feature of the pool 100 may be formed of the same materials or of different materials.

The plurality of wall panels 102 may be joined together along with the plurality of corner panels 104 to form the outer structure and sides of the pool 100. The pool 100 is formed up at an upper edge of the plurality of wall panels 102 and the plurality of corner panels 104 to allow for concrete or a deck to be formed around the pool 100. The plurality of encapsulation members 106 may be coupled to the upper edge of the plurality of wall panels 102 and the plurality of corner panels 104 to form up the pool 100. Additionally, each of the encapsulation members 106 may include at least two encapsulation portions, as are discussed in further detail below in reference to FIGS. 9A-13B, that are coupled to one another to form at least one of the encapsulation members 106.

In some embodiments, the pool cover assembly 108 is automated and is at least partially housed in a housing 110 at a first end 115 of the pool 100. The housing may also include a roller tube 112, which a pool cover (not shown in FIG. 1 for clarity purposes) is rolled up on and rolled off of inside the housing 110. The pool cover may be in a stored position when the pool cover is rolled up on the roller tube 112 and may be in a deployed position when the pool cover has been at least partially rolled off the roller tube 112 to at least partially cover the pool 100.

When the pool cover assembly 108 is automated, a motor may be used to extend the pool cover across the pool 100. For example, the motor may cause a leading edge bar 114, which is coupled to the fabric of the pool cover, to move from the first end 115 of the pool 100 proximate to the housing 110 to extend in a direction towards a second end 116 of the pool 100 and may cause the pool cover to at least partially roll off the roller tube 112. The second end 116 of the pool 100 is positioned at an opposite end of the pool 100 from the first end 115. When the leading edge bar 114 with the coupled pool cover is positioned at the second end 116, the pool is covered or enclosed by the pool cover. However, for clarity purposes, this is not shown in FIG. 1. The motor may also be used to retract the pool cover when the pool cover is in a deployed position by causing the leading edge bar 114 to move from the second end 116 to the first end 115 and at least partially roll up the pool cover on the roller tube 112.

In some embodiments, the roller tube 112 may act as a winch and rolls a rope onto the roller tube 112. The rope may be attached to the leading edge bar 114 and may extend through a set of pulleys positioned at the second edge 116. Thus the rope may be moved by the motor through the set of pulleys to cause the leading edge bar 114 to move and the pool cover to at least partially roll up on or off of the roller tube 112. The rope may be a Dyneema® or an ultra-high-molecular-weight polyethylene (UHMWPE) rope or any other suitable type of rope.

In some embodiments, the housing 110 forms up the first edge 115 of the pool 100 while the plurality of encapsulation members 106 form up the remaining three edges including the second edge 116. In further embodiments, the plurality of encapsulation members 106 may form up all four edges of the pool 100. Though the pool 100 is shown having four edges, more or fewer edges may define the pool 100.

Figure 2:
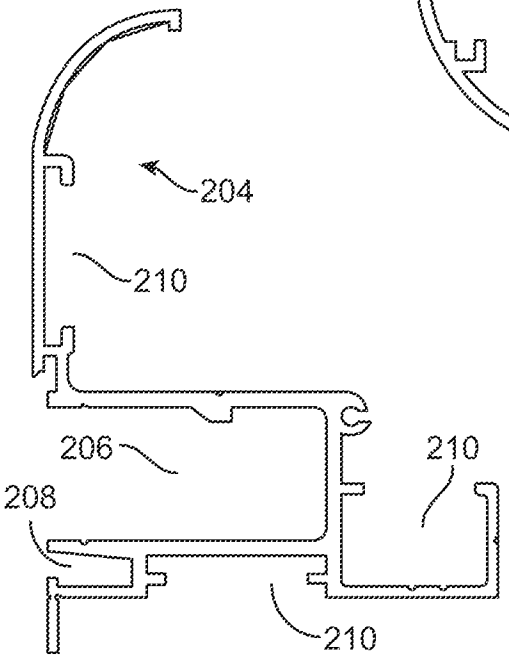
FIG. 2 is a cross-sectional view of an encapsulation member with a coping portion according to certain embodiments of the present disclosure.

FIGS. 2-6 illustrate various embodiments of one of the plurality of encapsulation members 106 that may be used in forming the pool 100. For example, according to certain embodiments of the present disclosure, as shown in FIG. 2, the encapsulation member 200 may include a coping portion 204. In some embodiments, the coping portion 204 defines a perimeter of the pool 100 where a pool deck meets a pool edge and may have any suitable shape, e.g., the discussion below regarding FIGS. 3 and 4. The encapsulation member 200 may include various recesses that form a cover track recess 206, a vinyl liner channel 208, and a plurality of splice recesses 210. In some embodiments, at least one of the plurality of splice recesses 210 is located along the coping portion 204. The cover track recess 206, vinyl liner channel 208, and plurality of splice recesses 210 may extend continuously along the entire length of the encapsulation member 200 or only partially along the length of the encapsulation member 200.

The plurality of splice recesses 210 may receive at least a portion of at least one splice member, e.g., splice member 916, 1008, 1106, 1200, 1300 as shown in FIGS. 9A-13B, to couple a first encapsulation portion to a second encapsulation portion, as discussed below in more detail in relation to FIGS. 9A-13B. The vinyl liner channel 208 may receive at least a portion of the vinyl liner used to cover the pool surfaces. In some embodiments, the vinyl liner channel 208 may receive a vinyl liner bead that helps to secure the vinyl liner within the vinyl liner channel 208. The cover track recess 206 may receive at least a portion of at least one of the leading edge bar or the pool cover, as discussed above in relation to FIG. 1.

Figure 3:
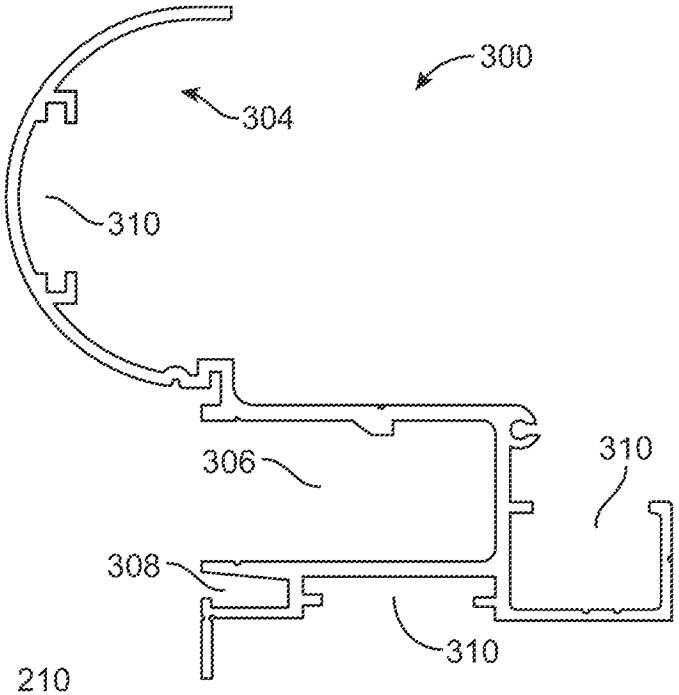
FIG. 3 is a cross-sectional view of an encapsulation member with a coping portion according to certain embodiments of the present disclosure.

In some embodiments, for example as shown in FIG. 3, an encapsulation member 300 may include the same or similar elements as the encapsulation member 200 discussed in relation to FIG. 2. For example, the encapsulation member 300 may include a coping portion 304 and various recesses that form a cover track recess 306, a vinyl liner channel 308, and a plurality of splice recesses 310. In some embodiments, the coping portion 304 may have a different shape than the coping portion 204, for example, the coping portion 304 may be formed as a bullnose coping.

Figure 4:
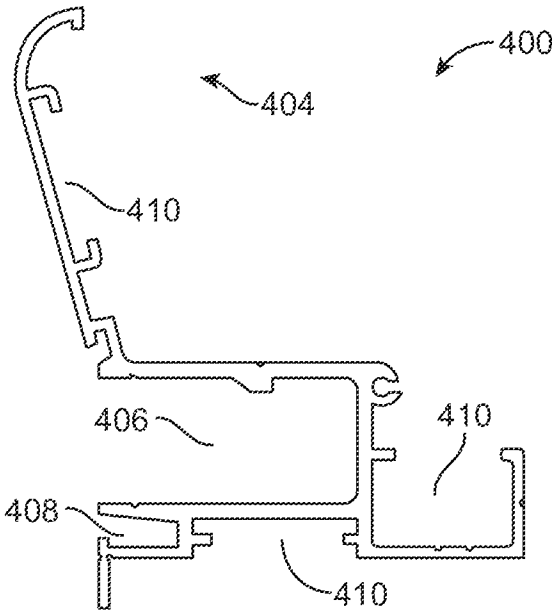
FIG. 4 is a cross-sectional view of an encapsulation member with a coping portion according to certain embodiments of the present disclosure.

In some embodiments, for example as shown in FIG. 4, an encapsulation member 400 may include the same or similar elements as the encapsulation members 200, 300 discussed in relation to FIGS. 2 and 3. For example, the encapsulation member 400 may include a coping portion 404 and various recesses that form a cover track recess 406, a vinyl liner channel 408, and a plurality of splice recesses 410. In some embodiments, the coping portion 404 may have a different shape than the coping portion 204, 304, for example, the coping portion 304 may be formed as an inclined coping.

Figure 6:
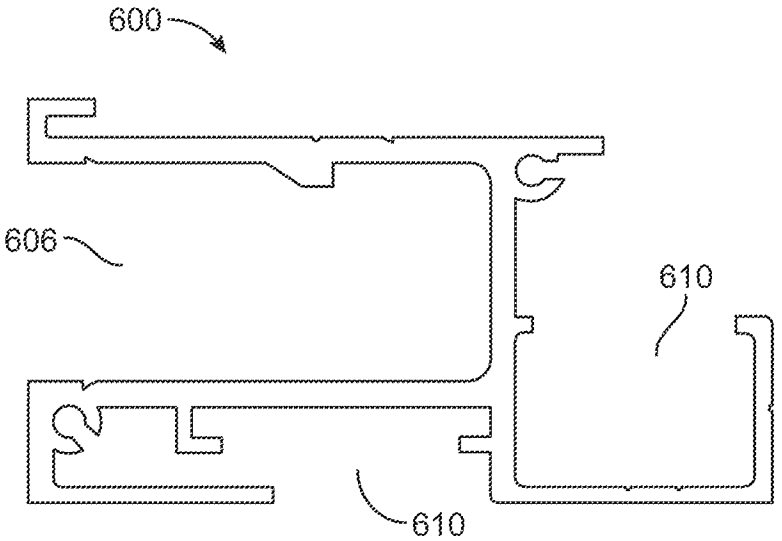
FIG. 6 is a cross-sectional view of an encapsulation member according to certain embodiments of the present disclosure.
Figure 5:
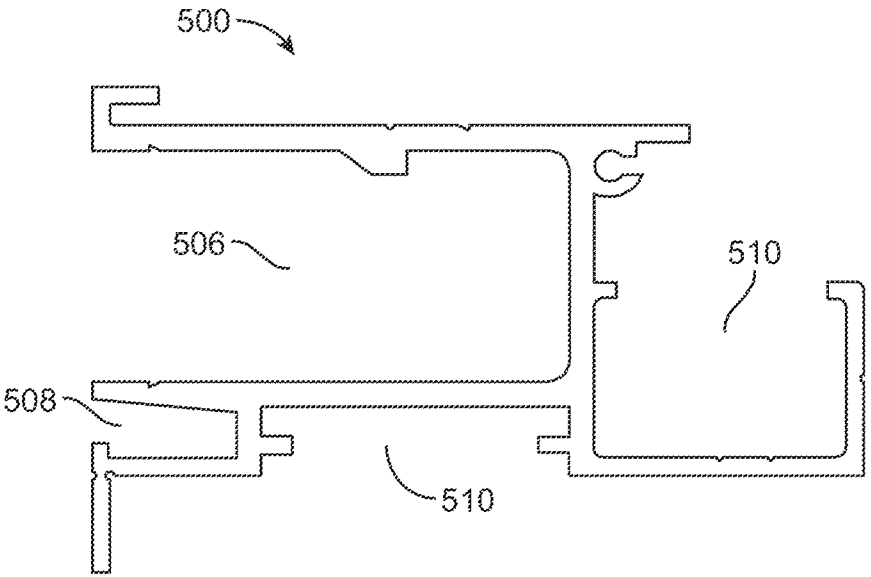
FIG. 5 is a cross-sectional view of an encapsulation member according to certain embodiments of the present disclosure.

According to certain embodiments of the present disclosure, as shown in FIGS. 5 and 6, the encapsulation member 500, 600 does not include a coping portion.

The encapsulation member 500, as best shown in FIG. 5, may include various recesses that form a cover track recess 506, a vinyl liner channel 508, and a plurality of splice recesses 510. The cover track recess 506, the vinyl liner channel 508, and the plurality of splice recesses 510 may be the same or similar to those described above in relation to FIGS. 2-4. The encapsulation member 500 may be used for pools that will have a separately formed coping. For example, where concrete, stone, or other material is used to form the coping.

The encapsulation member 600, as best shown in FIG. 6, may include various recesses that form a cover track recess 606 and a plurality of splice recesses 610. The cover track recess 606 and the plurality of splice recesses 610 may be the same or similar to those described above in relation to FIGS. 2-6. The encapsulation member 600 may be formed without a vinyl liner channel. Thus, the encapsulation member 600 may be used for assemblies that do not require a vinyl lining, e.g., fiberglass and/or gunite, and that will have a separately formed coping. For example, where concrete, stone, or other material is used to form the coping.

In some embodiments, an encapsulation member may include any combination of features discussed with respect to the encapsulation member 200, 300,400, 00, 600 as shown in FIGS. 2-6.

Referring back to FIG. 1, the plurality of encapsulation members 106 may each include a cover track recess, e.g., cover track recess 206, 306, 406, 506, 606, that connect to form a cover track recess extending around two or more edges of the pool 100. For example, in some embodiments, the cover track recess may extend around three sides of the pool 100 excluding the first edge 115. In some embodiments, only the encapsulation members 106 located at a third edge 118 and a fourth edge 120 each include a cover track recess that extends the full length of the pool 100. Thus, the leading edge bar 114 and the pool cover coupled to the leading edge bar 114 may travel within the cover track recess defined by encapsulation member 106 as the pool cover is extended and retracted. In some embodiments, the pool cover may include a bead or other suitable feature, as discussed in further detail below in relation to FIGS. 14A-14B, extending along the length of the pool cover that may engage with the track to retain the pool cover within the cover track recess and above the water of the pool 100.

In some embodiments, such as those used in forming a vinyl liner pool, a corner of the pool 100, for example corner 122, may include at least one liner corner plate 124. The at least one liner corner plate 124 alters the angle of the corner 122 of the pool 100 where the vinyl liner is inserted so that the corner 122 is not a 90° corner. Having a corner 122 that is not a 90° corner may assist with the ease of installation of the vinyl liner. In some pools 100, multiple corners 122 may each include one of the liner corner plates 124.

A corner connection assembly, as described in further detail below in relation to FIGS. 7A-8C, may be used to form the corner 122. The corner connection assembly includes a number of benefits including time, labor, and cost savings because the corner connection assembly does not require that the two encapsulation members 106 be cut at specific angles, be glued together using plates, brackets, and other parts, or be mitered to form the corner 122.

According to certain embodiments of the present disclosure, as shown in FIGS. 7A-7D, a corner connection assembly 700 may include at least two encapsulation members 702, a corner endcap member 704, a coping clip 706, and a liner corner plate 708. The at least two encapsulation members 702 may be the same or similar to the encapsulation members 106, 200, 300, 400, 500, 600 discussed above in relation to FIGS. 1-6. For example, each of the at least two encapsulation members 702 may include a coping portion 710, a cover track recess 714, a liner channel 716, and at least one splice recess 717. Additionally, the liner corner plate 708 may be the same or similar to the liner corner plate 124 discussed above in relation to FIG. 1.

The various elements of the corner connection assembly 700, including the at least two encapsulation members 702, the corner endcap member 704, the coping clip 706, and the liner corner plate 708 may be formed by molding, die casting, machining, 3D printing, casting, or any other suitable manufacturing means.

The corner connection assembly 700 may facilitate the installation of a corner of a pool by providing a simple and efficient system for the connection of two encapsulation members 702. In some embodiments, the corner connection assembly 700 reduces the total number of pieces needed to form the corner. By reducing the number of pieces needed for the corner connection assembly 700, the shipping and handling of the unassembled pool kit may be easier and cheaper. Additionally, as described below in further detail, the corner connection assembly 700 may provide a radius corner or an angled corner that is angled at less than 90°, e.g., a 45° angled corner. Thus, a vinyl liner may be able to be more easily installed into the cover track recess 714 at the corner. The corner endcap member 704 may be formed so that at least a portion of each of the at least two encapsulation members 702 may be inserted into at least two respective portions of the corner endcap member 704, or vice versa, to couple the corner endcap member 704 to the at least two encapsulation members 702. For example, the corner endcap member 704 may have a plurality of mating features, e.g., a plurality of protrusions 718 and a plurality of tracks defining a plurality of recesses 720 that are each sized and shaped to be inserted into and received by, respectively, a plurality of mating features, e.g., a plurality of protrusions 719 and a plurality of tracks defining a plurality of recesses 721, of the at least two encapsulation members 702. Thus, the size and shape of the plurality of protrusions 718 and the plurality of recesses 720, as well as other elements of the corner endcap member 704, are formed to be compatible with the size and shape of the plurality of protrusions 719 and the plurality of recesses 721 of the at least two encapsulation members 702.

In some embodiments, the mating features of the corner endcap member 704 may interlock with the mating features of the at least two encapsulation members 702. The interlocking may be achieved through the use of at least one of a snap-fit engagement between the corner endcap member 704 and the at least two encapsulation members 702, a friction fit engagement between the corner endcap member 704 and the at least two encapsulation members 702, a snap button engagement between the corner endcap member 704 and the at least two encapsulation members 702, or any other suitable feature for coupling the corner endcap member 704 to the at least two encapsulation members 702.

For example, the plurality of protrusions 718 of the corner endcap member 704 may each be sized and shaped to be inserted into a respective recess of the plurality of recesses 721 of each of the at least two encapsulation members 702 such that the corner endcap member 704 and the at least two encapsulation members 702 may be secured together using frictional engagement between the plurality of protrusions 718 and the plurality of recesses 721. Additionally, the plurality of protrusions 719 of each of the at least two encapsulation members 702 may each be inserted into a respective recess of the plurality of recesses 720 of the corner endcap member 704 such that the corner endcap member 704 and the at least two encapsulation member 702 may be secured together using frictional engagement between the plurality of protrusions 719 and the plurality of recesses 720.

In addition, in some aspects, additional features may aid in securing the corner endcap member 704 and the at least two encapsulation members 702 together, for example snap-fit engagement features, snap button engagement features, etc. These ways of interlocking the corner endcap member 704 with the at least two encapsulation members 702 allow for a quick, secure coupling of the corner endcap member 704 with the at least two encapsulation members 702 without requiring the use of adhesives or welding.

The at least two encapsulation members 702 may be coupled to the corner endcap member 704 such that the at least two encapsulation members 702 form a substantially 90° angle between the at least two encapsulation members 702. The phrase "substantially" means within usual manufacturing tolerances. For example, the angle between the at least two encapsulation members 702 may be between 85° and 95° and still be considered to be a substantially 90° angle in the context of the present disclosure. Additionally, the at least two encapsulation members 702 may form any suitable angle between the at least two encapsulation members 702 when coupled with the corner endcap member 704 based on the design of the corner endcap member 704 and the location of the attachment points between the corner endcap member 704 and each of the at least two encapsulation members 702.

Figure 7A:
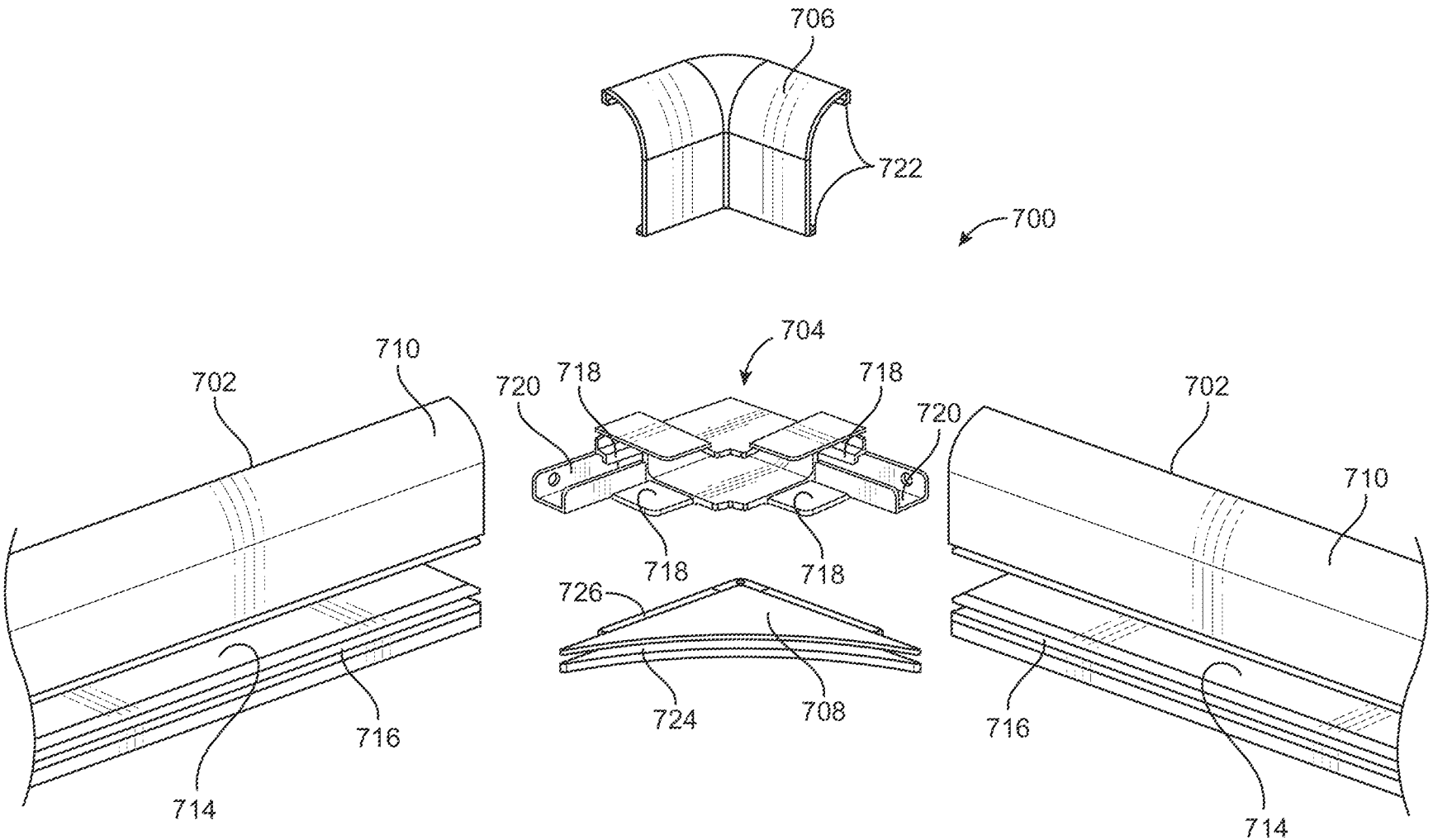
FIG. 7A is a front perspective exploded view of a corner connection assembly according to certain embodiments of the present disclosure.

In some embodiments, a coping clip may also be used in securing the coping portion 710 of each of the encapsulation members 702. For example, as shown in FIG. 7A, the coping clip 706 may be slid and/or snap-fitted onto the coping portions 710 of each of the coupled at least two encapsulation members 702 to secure the at least two encapsulation members 702 relative to each other as well as the corner endcap member 704. For example, the coping clip 706 may include at least one lip 722 that may be engageable with and/or snap-fit to at least a portion of the coping portions 710 of each of the coupled at least two encapsulation members 702. In some embodiments, the lip 722 may engage with at least one edge of each of the two encapsulation members 702. Similar to the connection between the at least two encapsulation members 702 and the corner endcap member 704, the coupling of the coping clip 706 to the coping portions 710 of each of the at least two encapsulation members 702 allow for a quick, secure coupling of the coping clip 706 with the at least two encapsulation members 702 without requiring the use of adhesives or welding.

The coping clip 706 may be excluded from use with the corner connection assembly 700. For example, in some embodiments each of the at least two encapsulation members 702 may not include a coping portion 710, such as is described in further detail below with respect to FIGS. 8A-8C. In such embodiments, the coping clip 706 may not be not used in forming the corner. In further embodiments, each of the at least two encapsulation members 702 do include a coping portion 710; however, the coping portions 710 do not require the coping clip 706 to form the coping corner.

Figure 7B:
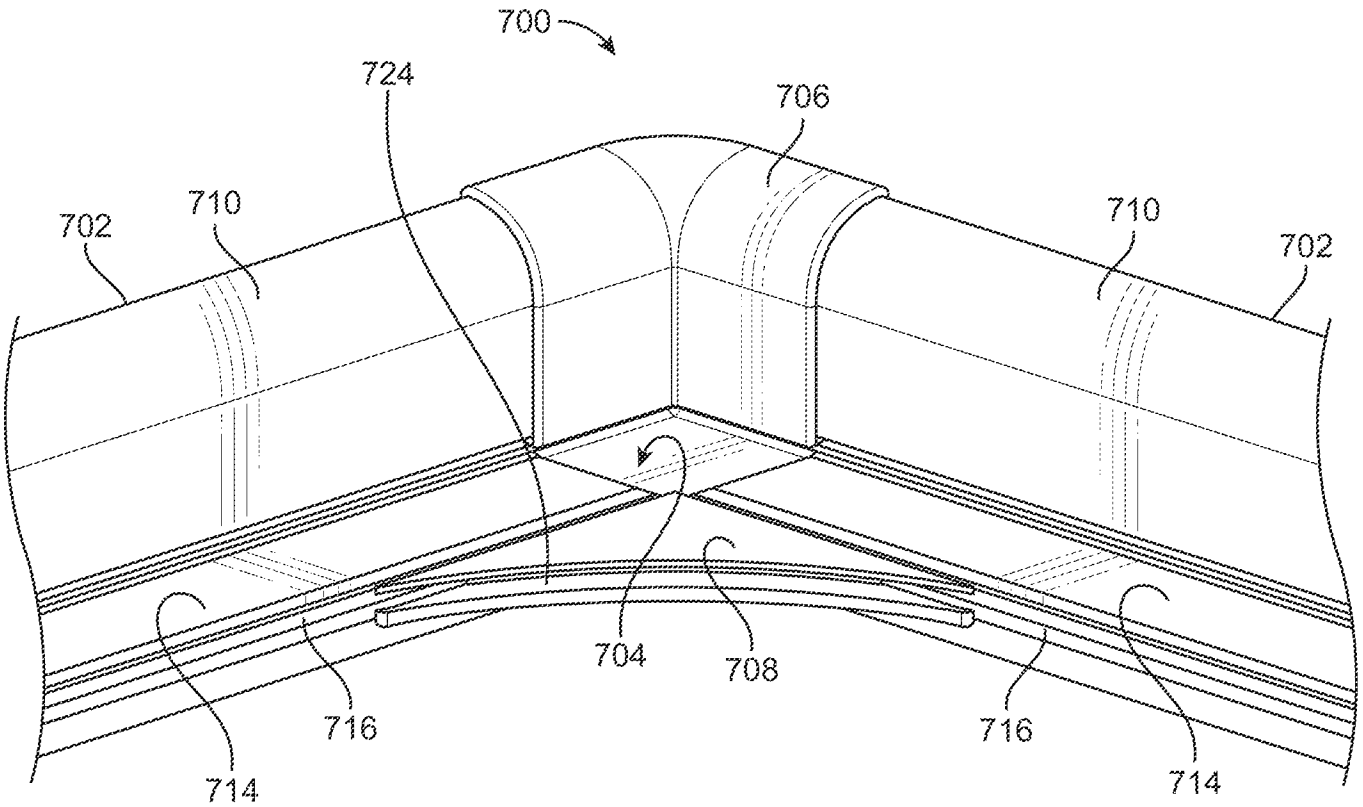
FIG. 7B is a front perspective view of the corner connection assembly of FIG. 7A in an assembled state.
Figure 7C:
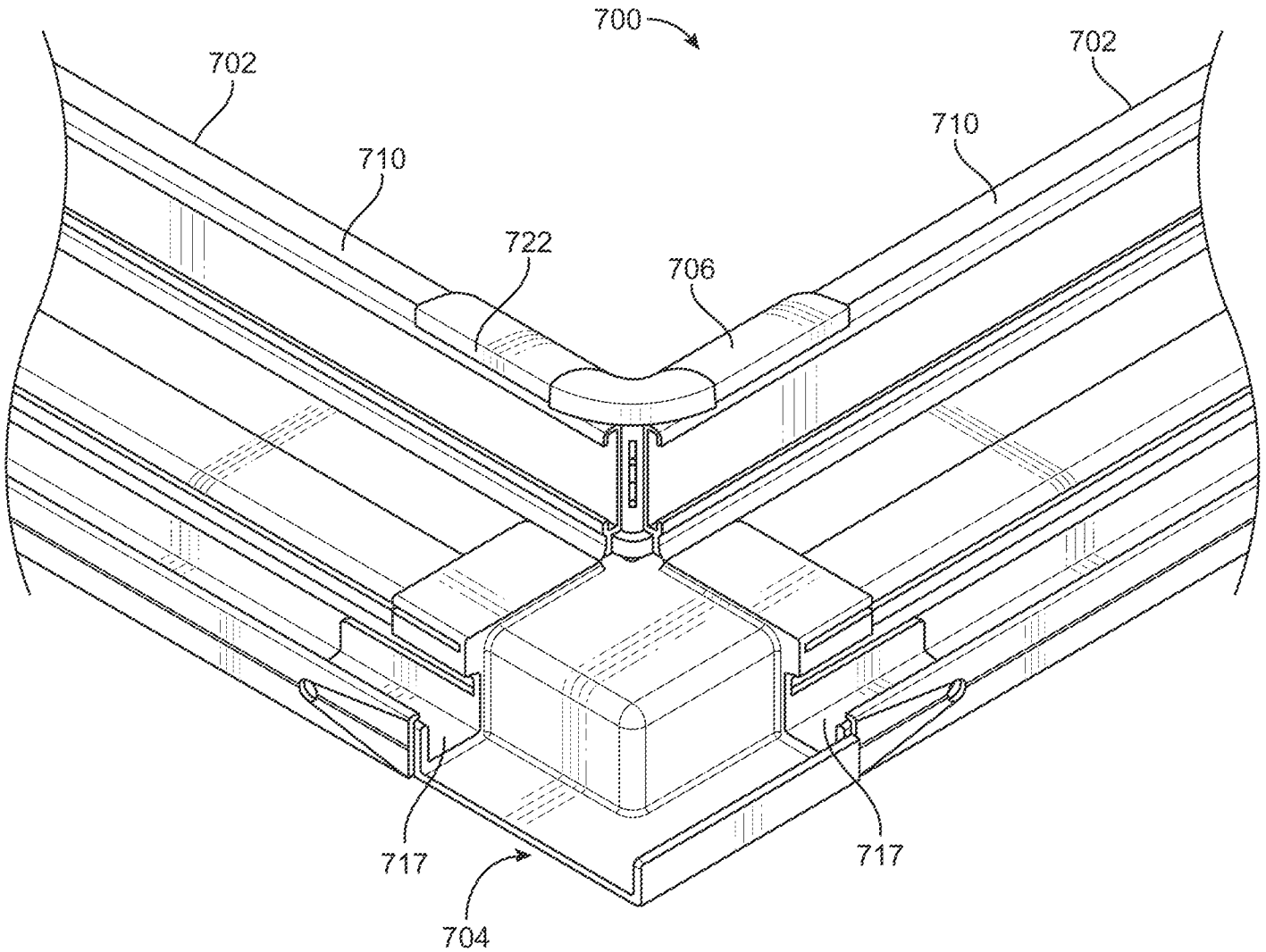
FIG. 7C is a rear perspective view of the corner connection assembly of FIG. 7A in an assembled state.
Figure 7D:
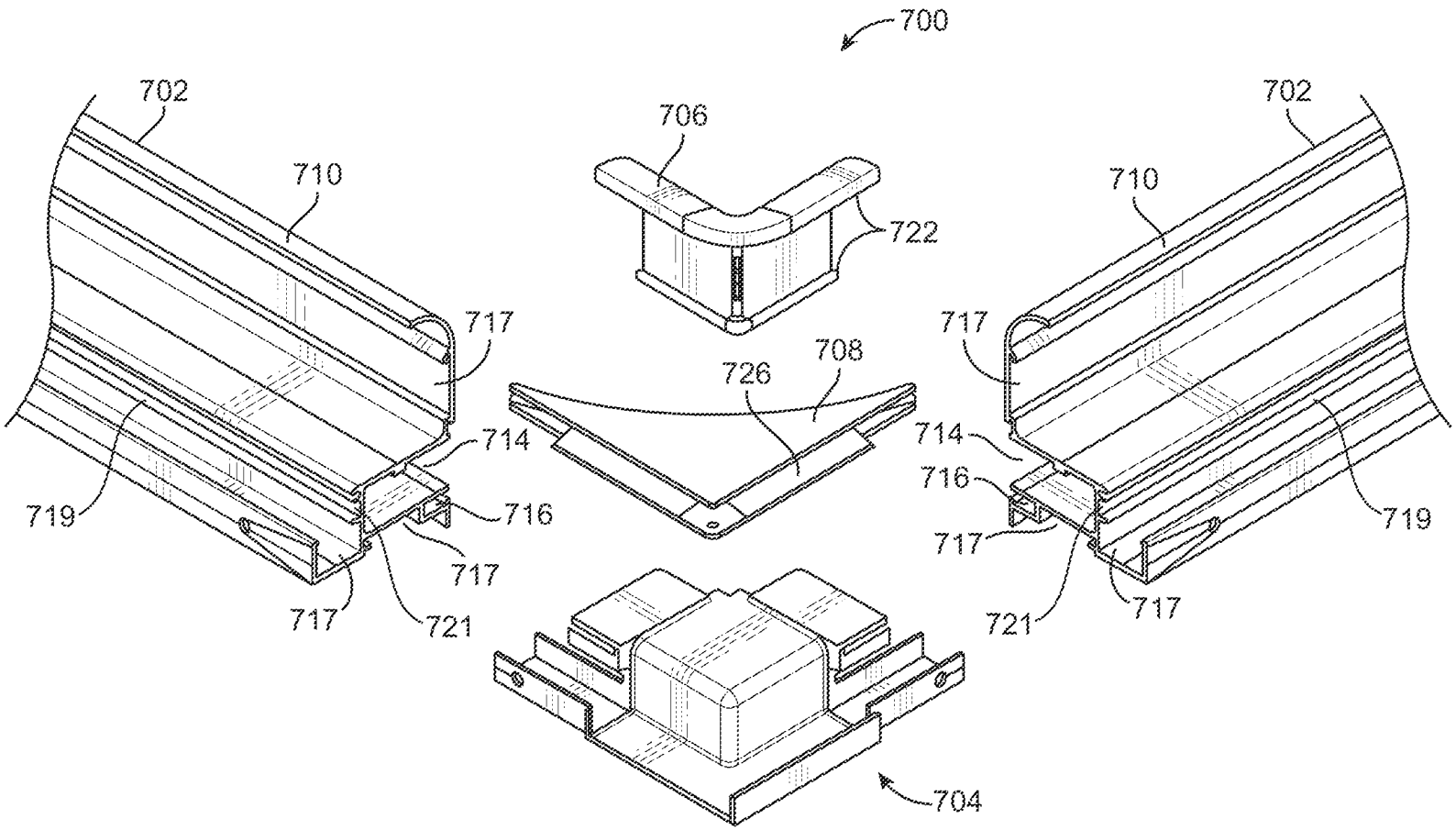
FIG. 7D is a rear perspective exploded view of the corner connection assembly of FIG. 7A.

FIG. 7A depicts an exploded view of the corner connection assembly 700, FIG. 7B depicts an assembled front view of the corner connection assembly 700, FIG. 7C depicts an assembled rear view of the corner connection assembly 700, and FIG. 7D depicts an exploded rear view of the corner connection assembly 700. As best illustrated in FIGS. 7B and 7C, the at least two encapsulation members 702, the corner endcap member 704, and the coping clip 706 may all be coupled together to form a 90° corner. The corner endcap member 704 may be used to help form the encapsulation corner of the corner connection assembly 700, and the coping clip 706 may be used to help form the coping corner of the corner connection assembly 700.

In some embodiments, a liner corner plate 708 may be coupled with at least two encapsulation members 702, the corner endcap member 704, and the coping clip 706. In some embodiments, the liner corner plate 708 may be the same or similar to the modular corner piece disclosed in U.S. Pat. No. 7,114,297. For example, the liner corner plate 708 may include a liner channel 724 for receiving a liner, e.g., a vinyl liner, and at least one connection protrusion 726. The liner corner plate 708 may have a 6-inch radius, a 2-foot radius, a 4-foot radius, a 45 degree chopped corner, or any other suitably sized radius or angled corner. Additionally, the liner corner plate 708 may be a solid, one-piece element formed by die casting.

In some embodiments, the at least one connection protrusion 726 may be inserted into and coupled with at least a portion of the liner recess 716 of each of the at least two encapsulation members 702. In further embodiments, the at least one connection protrusion 726 may be at least partially inserted into and coupled with at least one recess 720 of the corner endcap member 704 when the at least two encapsulation members 702 are coupled to the corner endcap member 704. In still further embodiments, the at least one connection protrusion 726 may be inserted into and coupled with at least a portion of the liner recess 716 of each of the at least two encapsulation members 702 as well as at least one recess 720 of the corner endcap member 704.

The at least one connection protrusion 726 may be snap or friction fit within the portion of the liner recess 716 of each of the at least two encapsulation members 702, and in some embodiments within the at least one recess 720 of the corner endcap member 704, which allows for a quick, secure coupling of the at least one connection protrusion 726 with the at least two encapsulation members 702 without requiring the use of adhesives or welding. Additionally, a shim or splice may be used to help secure the liner corner plate 708 within the liner recess 716 of each of the at least two encapsulation members 702. Enabling the coupling of the at least two encapsulation members 702, the corner endcap member 704, the coping portion 710, and the liner corner plate 708 without requiring the use of adhesives or welding provides for ease of installation and allows for these features to be easily removed from the pool in the case that they need to be repaired or replaced, e.g., due to damage.

Figure 8A:
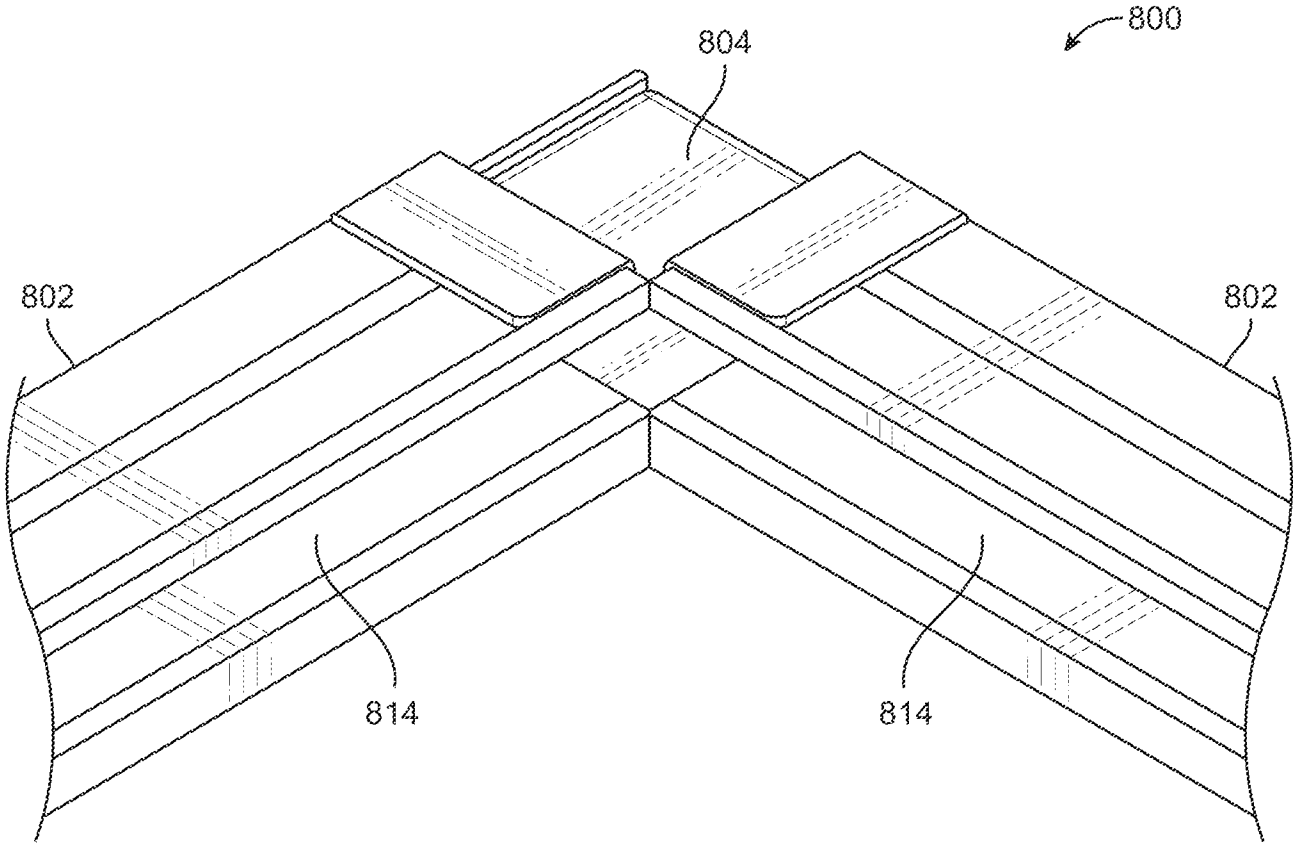
FIG. 8A is a front perspective view of a corner connection assembly in an assembled state according to certain embodiments of the present disclosure.
Figure 8B:
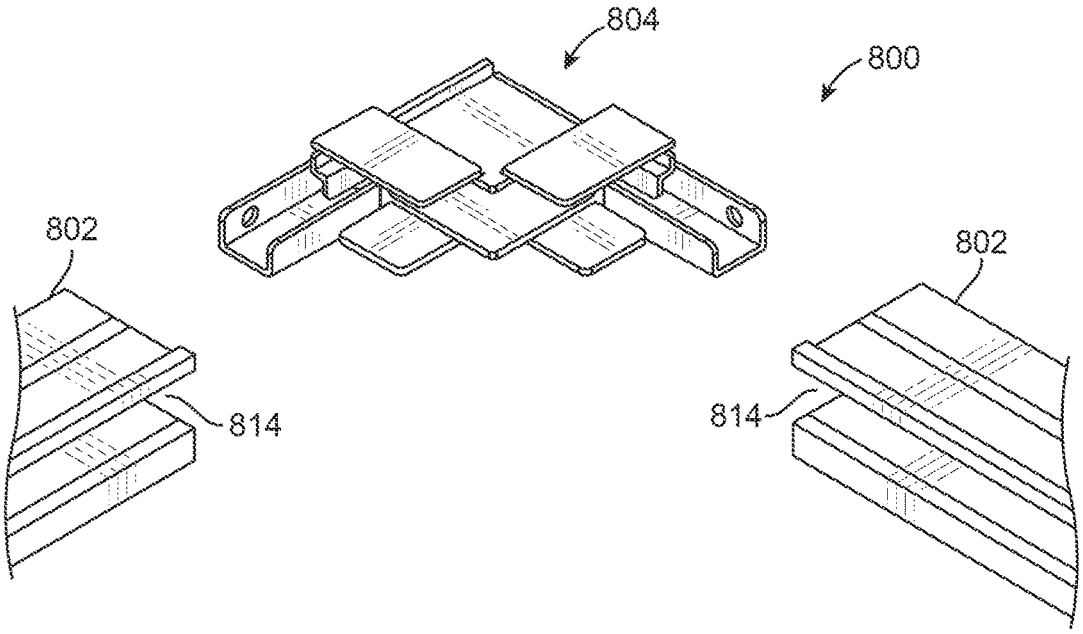
FIG. 8B is a front perspective exploded view of the corner connection assembly of FIG. 8A.
Figure 8C:
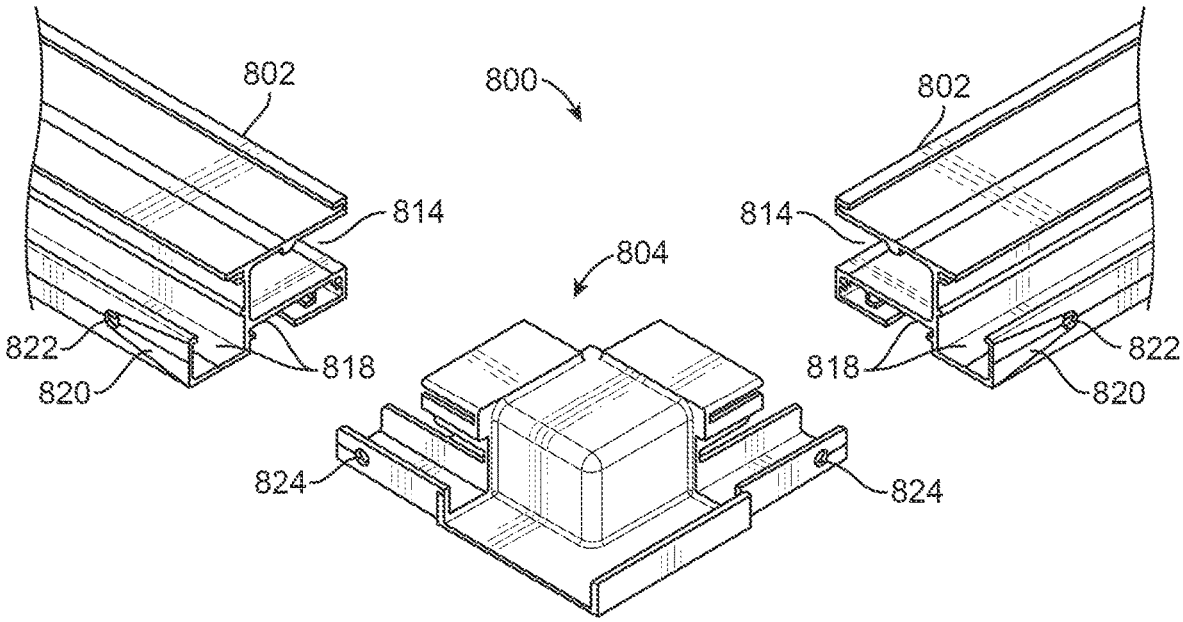
FIG. 8C is a rear perspective exploded view of the corner connection assembly of FIG. 8A.

According to certain embodiments of the present disclosure, as shown in FIGS. 8A-8C, a corner connection assembly 800 may include similar elements as those in the corner connection assembly 700 described above in relation to FIGS. 7A-7D. The corner connection assembly 800 may include at least two encapsulation members 802 and a corner endcap member 804. The at least two encapsulation members 802 may be the same or similar to the encapsulation members 106, 200, 300, 400, 500, 600, 702 discussed above in relation to FIGS. 1-7D. For example, each of the at least two encapsulation members 802 may include a cover track recess 814 and at least one splice recess 818.

As shown in FIGS. 8A-8C, the corner connection assembly 800 does not include a coping portion, a coping clip, or a vinyl liner recess. In some embodiments, one or more of these features may be included in the corner connection assembly 800. In some embodiments, the corner connection assembly 800 may be used when forming gunite or fiberglass pools. However, it is understood that the corner connection assembly 800 may include additional features, e.g., a coping portion and be used to form a gunite or fiberglass pool.

In a similar or the same way as described above with respect to the corner connection assembly 700 described in relation to FIG. 7, the at least two encapsulation members 802 may be coupled to the corner endcap member 804. For example, the size, shape, protrusions, and recesses of the endcap member 804 may correspond respectively to the size, shape, recesses, and protrusions of the at least two encapsulation members 802 so that two encapsulation members 802 may be interlocked with the corner endcap member 804. In some embodiments, each of the two encapsulation members 802 may include a snap button member 820 positioned within a splice recess 818, or at any other suitable location of each of the two encapsulation members 802, that includes a protrusion 822 that engages with an opening 824 in the corner endcap member 804 when the two encapsulation members 802 are coupled to the corner endcap member 804. The snap button member 820, the protrusion 822, and the opening 824 may be located at any suitable corresponding location on the respective encapsulation member 802 and corner endcap member 804.

Figure 9B:
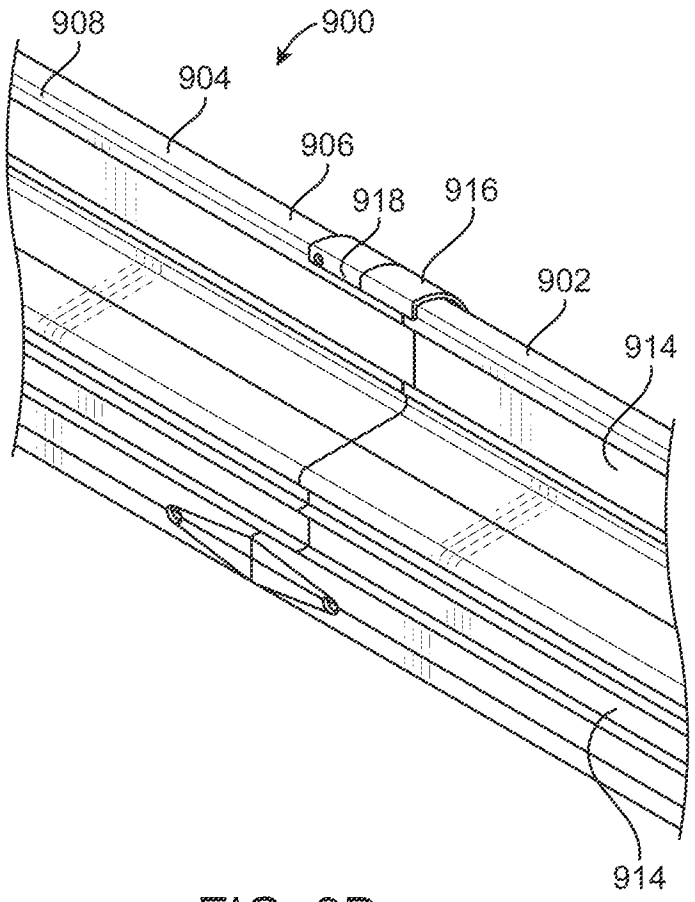
FIG. 9B is a rear perspective view of the two encapsulation portions coupled via the splice member of FIG. 9A.
Figure 9A:
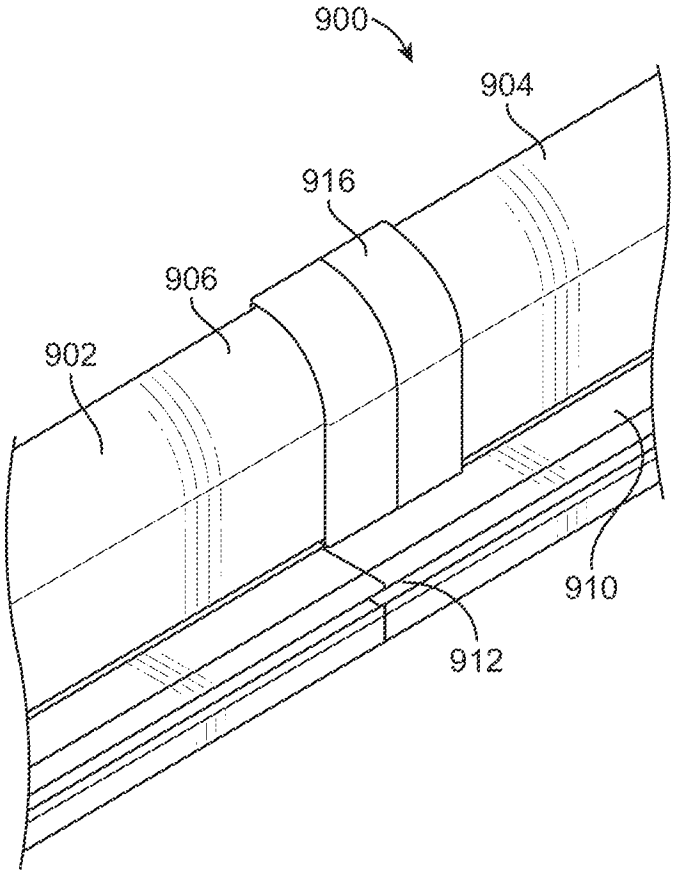
FIG. 9A is a front perspective view of two encapsulation portions coupled via a splice member according to certain embodiments of the present disclosure.
Figure 9D:
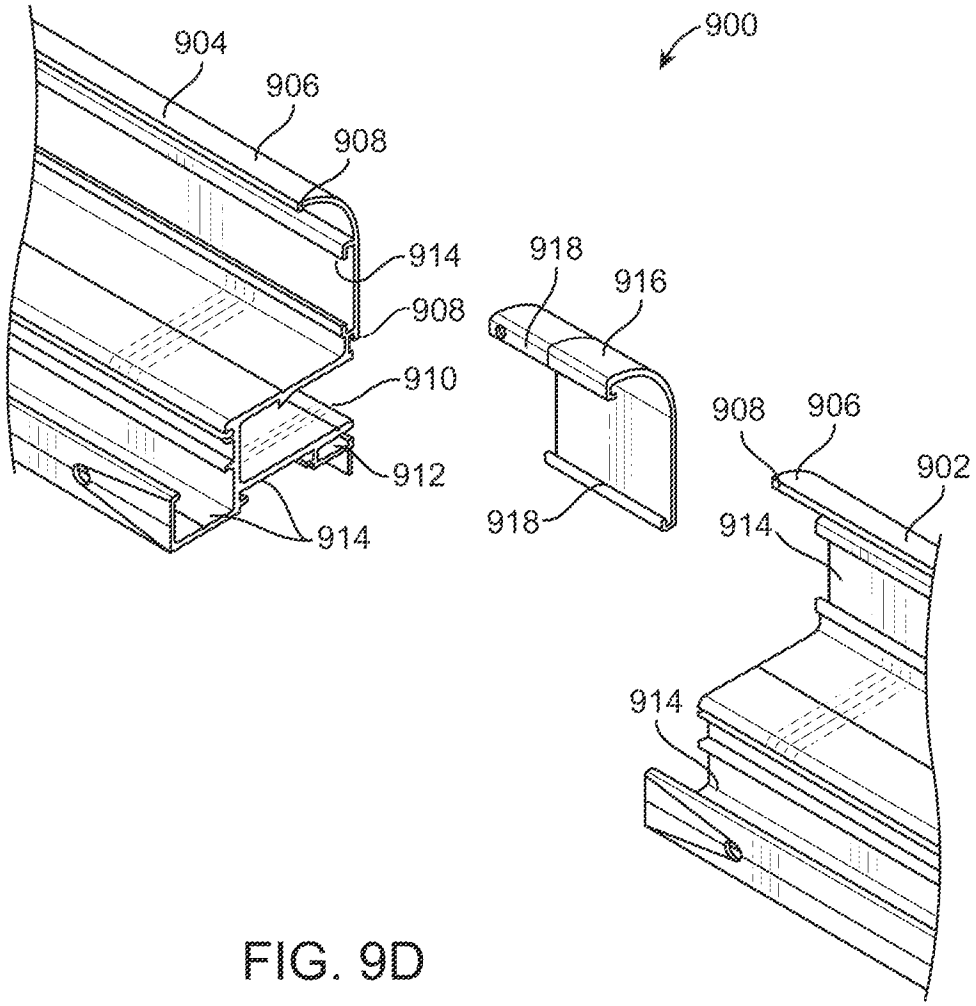
FIG. 9D is a rear perspective exploded view of the two encapsulation portions with the splice member of FIG. 9A.
Figure 9C:
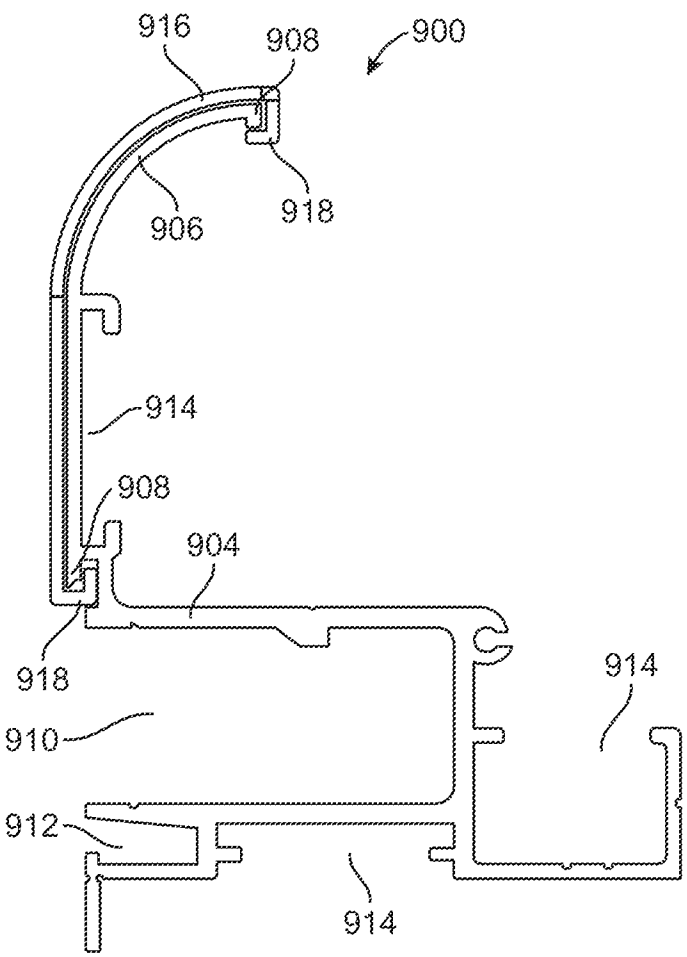
FIG. 9C is a cross-sectional view of the two encapsulation portions coupled via the splice member of FIG. 9A.
Figure 10A:
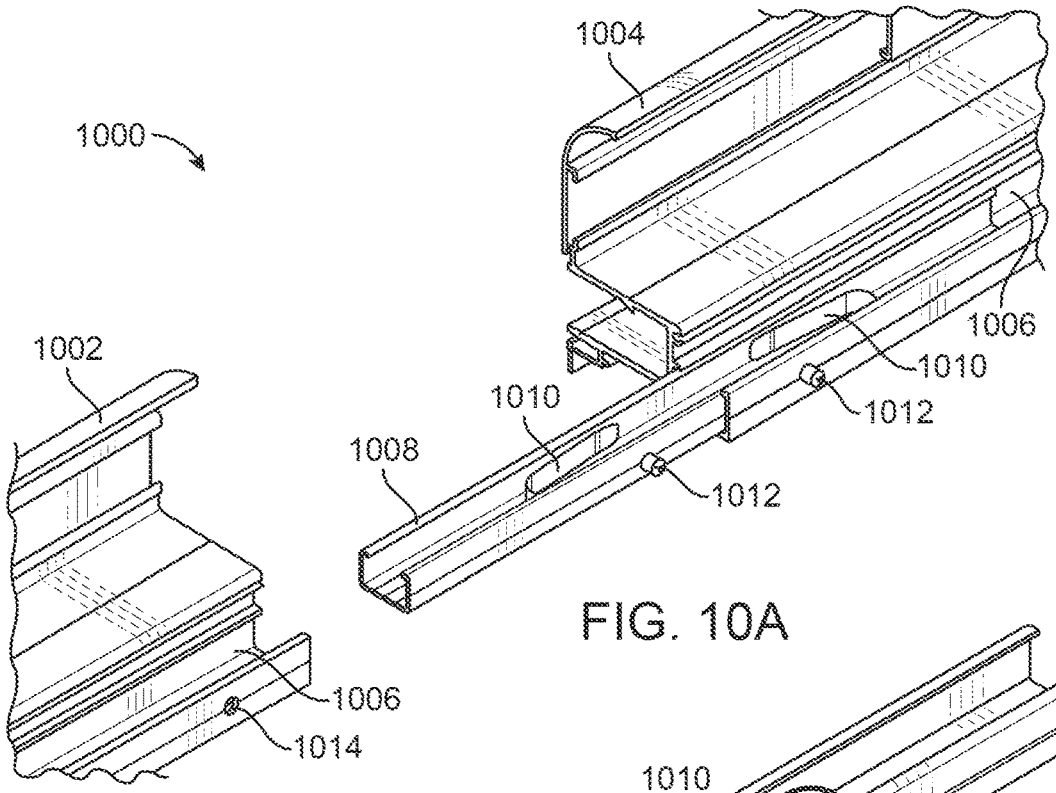
FIG. 10A is a rear perspective view of two encapsulation portions with a splice member partially coupled to one encapsulation portion according to certain embodiments of the present disclosure.
Figure 10B:
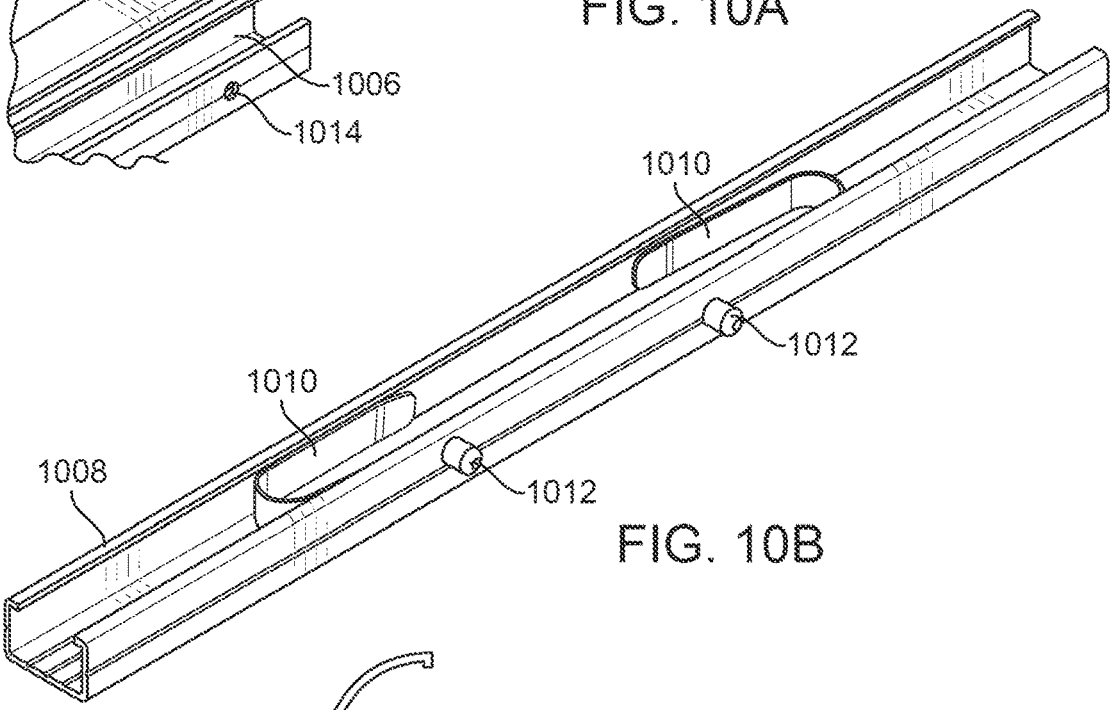
FIG. 10B is a rear perspective view of the splice member of FIG. 10A.
Figure 10C:
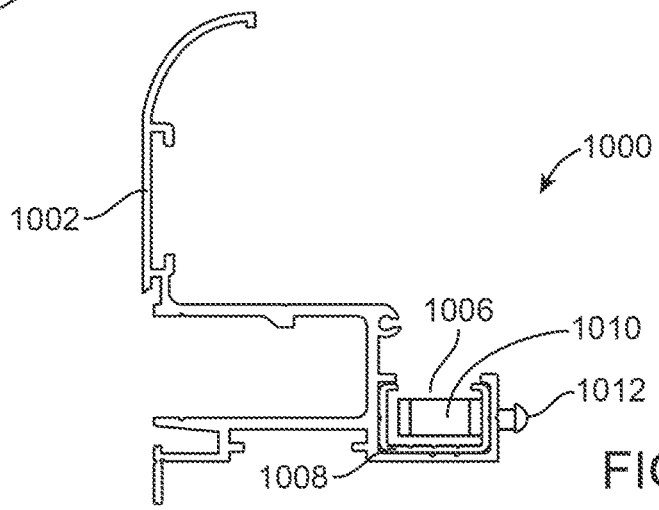
FIG. 10C is a cross-sectional view of the splice member partially coupled with one encapsulation portion of FIG. 10A.

One side of a pool cover encapsulation, which may define a side of the pool, may be formed from an encapsulation member. Such encapsulation member may be formed from a plurality of encapsulation portions coupled together. For example, two, three, four, five, or more encapsulation portions may be coupled together to define a length of the encapsulation member defining a side of a pool. According to certain embodiments of the present disclosure, as shown in FIGS. 9A-9D, an encapsulation member 900 may include at least two separable portions, e.g., a first encapsulation portion 902 and a second encapsulation portion 904. The encapsulation member 900 may be the same or similar as or include the same or similar elements as the encapsulation members 106, 200, 300, 400, 500, 600, 702, 802 discussed above in relation to FIGS. 1-8C. For example, the encapsulation member 900 may include a coping portion 906, a cover track recess 910, a liner channel 912, and at least one splice recess 914. In some embodiments, the first encapsulation portion 902 and the second encapsulation portion 904 may be coupled together using a splice member 916 to form the encapsulation member 900. Additional encapsulation portions may be coupled to at least one of the first encapsulation portion 902 or the second encapsulation portion 904 where needed, for example, where a longer encapsulation member 900 is needed to form the side of the pool. FIG. 9A depicts a front perspective view of an assembled encapsulation member 900 that includes a first encapsulation portion 902 and a second encapsulation portion 904 coupled using the splice member 916, FIG. 9B depicts a rear perspective view of the assembled encapsulation member 900 that includes the first encapsulation portion 902 and the second encapsulation portion 904 coupled using the splice member 916, FIG. 9C depicts a cross-sectional view of the second encapsulation portion 904 coupled with the splice member 916, and FIG. 9D depicts a rear exploded perspective view of the encapsulation member 900 that includes the first encapsulation portion 902, the second encapsulation portion 904, and the splice member 916.

An encapsulation member 900 that is not separable into multiple encapsulation portions may be a very long piece, e.g., up to 22 feet in some instances. Pieces of this length create a number of difficulties in packaging, shipping, handling, etc. For example, an oversize load may include cargo that is greater than 8 feet and thus may incur additional shipping charges due to the size of the cargo. By forming each of the multiple encapsulation portions so that the length of each may be less than the length of an oversize load, e.g., 8 feet, shipping costs and additional difficulties may be reduced. In some embodiments, the length of one of the encapsulation portions may be approximately 1 foot, 2 feet, 3 feet, 4 feet, 5 feet, 6 feet, 7 feet, 8 feet, etc.

Coupling a plurality of smaller encapsulation portions, e.g., the first encapsulation portion 902 and the second encapsulation portion 904, together to form the encapsulation member 900 that defines the length of a pool side makes the packaging, shipping, handling, etc. easier because the encapsulation portions are smaller than the full length of the encapsulation member 900. The ability to separate the encapsulation member 900 into at least the first encapsulation portion 902 and the second encapsulation portion 904 helps to reduce difficulties encountered during shipping, damage to the packaging or the encapsulation member 900 itself, difficulties with package handling, transit costs, e.g., over-length fees would no longer be required, etc.

While some embodiments discuss an encapsulation member 900 that is formed by at least two portions that may be coupled together, any suitable feature of the pool may be formed in a similar manner. For example, the leading edge bar, the rolling tube, etc. may also be formed by coupling at least two separable portions of the respective feature together as is described in further detail below in relation to FIGS. 11A-13B.

In some embodiments, at least the first encapsulation portion 902 and the second encapsulation portion 904 may be coupled using a splice member 916. The splice member 916 may be a coping clip, as shown in FIGS. 9A-9D. Similar to as described above in relation to FIG. 7A-7D, the coping clip splice member 916 may be slid and/or snap-fitted onto the coping portions 906 to couple the first encapsulation portion 902 and the second encapsulation portion 904. For example, the coping clip splice member 916 may include at least one lip 918 that may be engageable with and/or snap-fit to at least a portion of the coping portions 906, e.g., edges 908, of the first encapsulation portion 902 and the second encapsulation portion 904 as may be seen in FIGS. 9B-9C.

The splice member 916 may couple the first encapsulation portion 902 and to the second encapsulation portion 904 by clipping over the meeting between the respective edges of the first encapsulation portion 902 and the second encapsulation portion 904. This provides a quick and easy connection of the first encapsulation portion 902 and the second encapsulation portion 904 without requiring the use of adhesives, welding, fasteners, etc. Though in some embodiments, adhesives, welding, fasteners, etc. may be used in conjunction with the coping clip splice member 916. Additionally, the coping clip splice member 916 may improve the aesthetic of the encapsulation member 900 by hiding the joint between the edges of the first encapsulation portion 902 and the second encapsulation portion 904.

According to certain embodiments of the present disclosure, as shown in FIGS. an encapsulation member 1000 may include at least two separable portions, e.g., a first encapsulation portion 1002 and a second encapsulation portion 1004. The encapsulation member 1000 may be the same or similar as or include the same or similar elements as the encapsulation members 106, 200, 300, 400, 500, 600, 702, 802, 900 discussed above in relation to FIGS. 1-9D. For example, the encapsulation member 1000 may include a coping portion, an encapsulation, a cover track recess, a liner channel, and at least one splice recess 1006.

In some embodiments, at least the first encapsulation portion 1002 and the second encapsulation portion 1004 may be coupled together using a splice member 1008 to form the single encapsulation member 1000. The splice member 1008 may fit within the at least one splice recess 1006 of the first encapsulation portion 1002 and the second encapsulation portion 1004 when first encapsulation portion 1002 and the second encapsulation portion 1004 are coupled together. Additional encapsulation portions may be coupled to at least one of the first encapsulation portion 1002 or the second encapsulation portion 1004 where needed.

As discussed above, the ability to form a desired length of the encapsulation member 1000 that defines a length of a pool side by coupling together a plurality of encapsulation portions, e.g., first encapsulation portion 1002 and second encapsulation portion 1004, and to separate the encapsulation member 1000 into at least the first encapsulation portion 1002 and the second encapsulation portion 1004 helps to reduce difficulties encountered during shipping, damage to the packaging or the encapsulation member 900 itself, difficulties with package handling, transit costs, e.g., overlength fees would no longer be required.

The splice member 1008 may include a length of material that is sized and shaped to be received in a recess of each of the first encapsulation portion 1002 and the second encapsulation portion 1004, e.g., splice recesses 1006. The splice member 1008 may also include at least two mating features, for example at least two snap buttons 1010 that each has at least one protrusion 1012. Each of the at least one protrusions 1012 is engageable with at least one opening 1014 in each of the first encapsulation portion 1002 and the second encapsulation portion 1004. The at least one opening 1014 may be located along an edge that defines the at least one splice recess 1006. Engaging at least one protrusion 1012 with at least one opening 1014 in each of the first encapsulation portion 1002 and the second encapsulation portion 1004 secures the first encapsulation portion 1002 and the second encapsulation portion 1004 to one another via the splice member 1008.

Any suitable number of splice members 1008 may be used to couple the first encapsulation portion 1002 to the second encapsulation portion 1004. Additionally, at least one splice member 916, described in relation to FIGS. 9A-9D, may be combined with at least one splice member 1008 in order to couple the first encapsulation portion 1002 to the second encapsulation portion 1004.

Figure 11B:
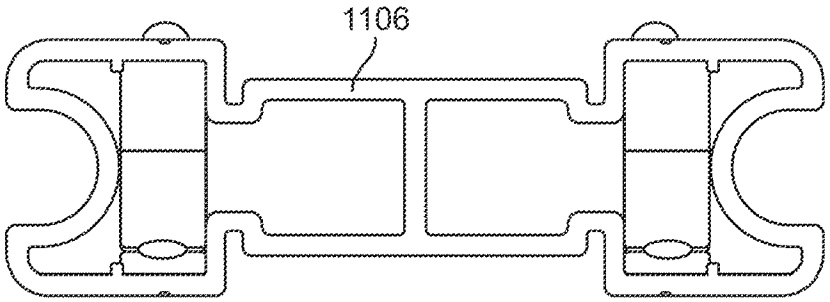
FIG. 11B is a cross-sectional view of the splice member of FIG. 11A.
Figure 11C:
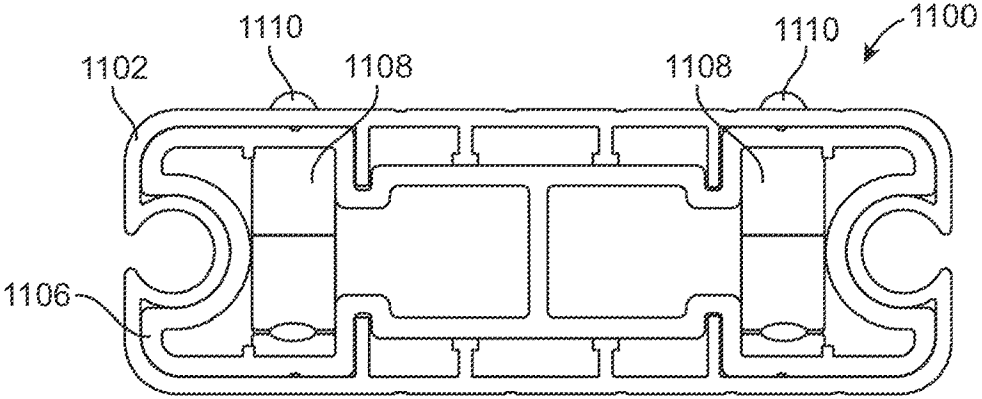
FIG. 11C is a cross-sectional view of the splice member with the partially coupled leading edge bar.
Figure 11A:
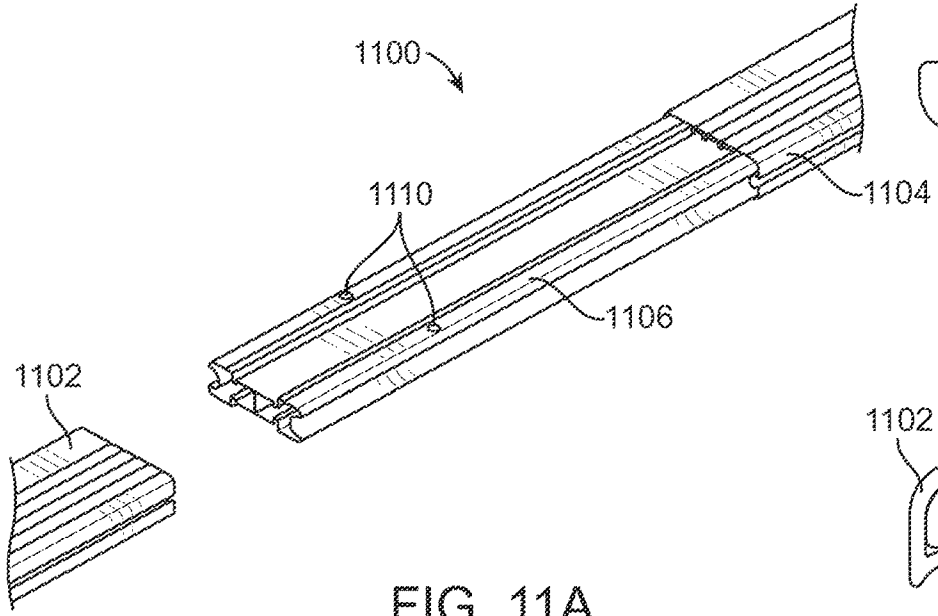
FIG. 11A is a front perspective view of a splice member with a partially coupled leading edge bar according to certain embodiments of the present disclosure.

A splice member with snap buttons, e.g., splice member 1008, may also be used to connect portions of other elements of the pool, e.g., the leading edge bar, roller tube, etc. For example, as shown in FIGS. 11A-11C, a leading edge bar 1100 may comprise at least two separable, e.g., a first portion 1102 and a second portion 1104, coupled together to form the leading edge bar 1100 using a splice member 1106. The leading edge bar 1100 may be the same or similar as or include the same or similar elements as the leading edge bar 114 discussed above in relation to FIG. 1.

FIG. 11A depicts a front perspective view of the splice member 1106 assembled with the second portion 1104 of the leading edge bar 1100, FIG. 11B depicts a cross-sectional view of the splice member 1106, and FIG. 11C depicts a cross-sectional view of the splice member 1106 assembled with the first portion 1102.

In some embodiments, the splice member 1106 may include at least two snap buttons 1108 that each has at least one protrusion 1110. Each of the at least one protrusions 1110 is engageable with at least one opening in each of the first portion 1102 and the second portion 1104. Engaging at least one protrusion 1110 with at least one opening 1014 in each of the first portion 1102 and the second portion 1104 secures the first portion 1102 and the second portion 1104 to one another.

According to certain embodiments, as shown in FIGS. 12A-12E a splice member 1200 may use an adjustable compression fit to couple two separable portions of an encapsulation member, a rolling tube, a leading edge bar, etc. together. For example, the splice member 1200 may have a substantially C-shaped, or semi-circular body 1202. An outer diameter A of the splice member 1200 may be adjustable, e.g., expandable and contractible, using at least one fastener 1204 positioned within the semi-circular body 1202 and extending at least partially through opposing sides of the semi-circular body 1202.

Figure 12B:
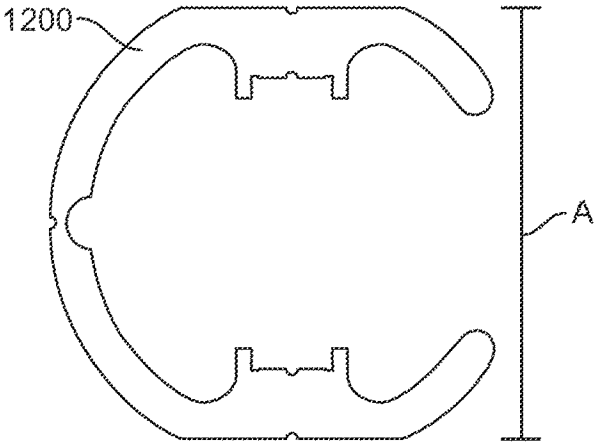
FIG. 12B is a cross-sectional view of the splice member of FIG. 12A without a fastener.
Figure 12C:
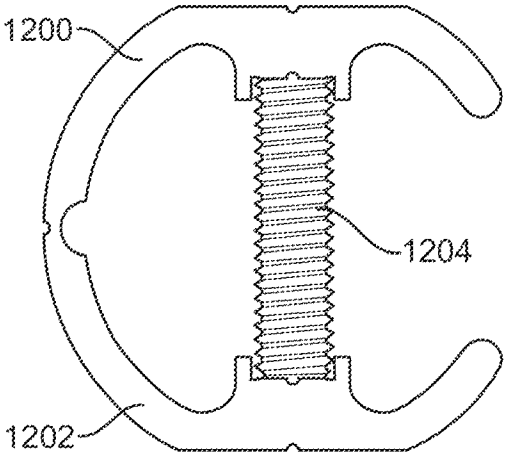
FIG. 12C is a cross-sectional view of the splice member of FIG. 12A.
Figure 12A:
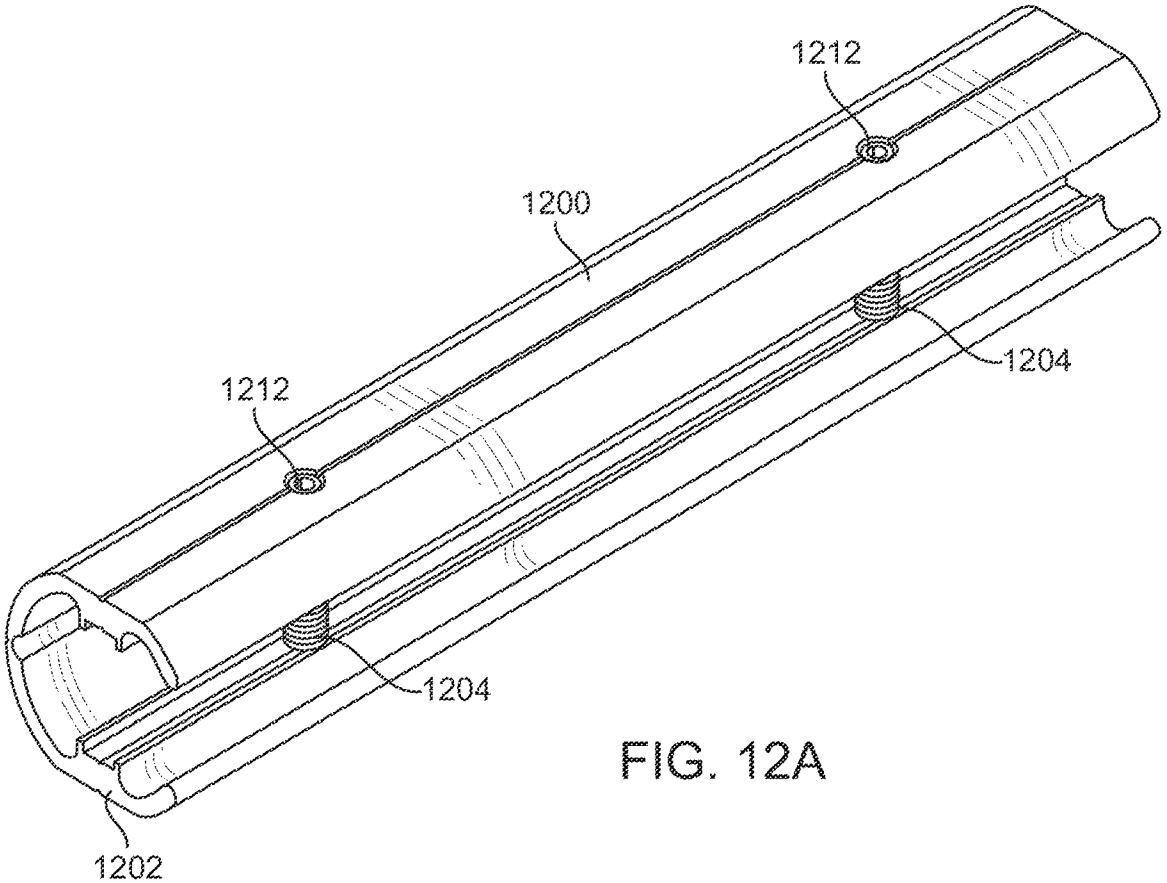
FIG. 12A is a front perspective view of a splice member according to certain embodiments of the present disclosure.
Figure 12E:
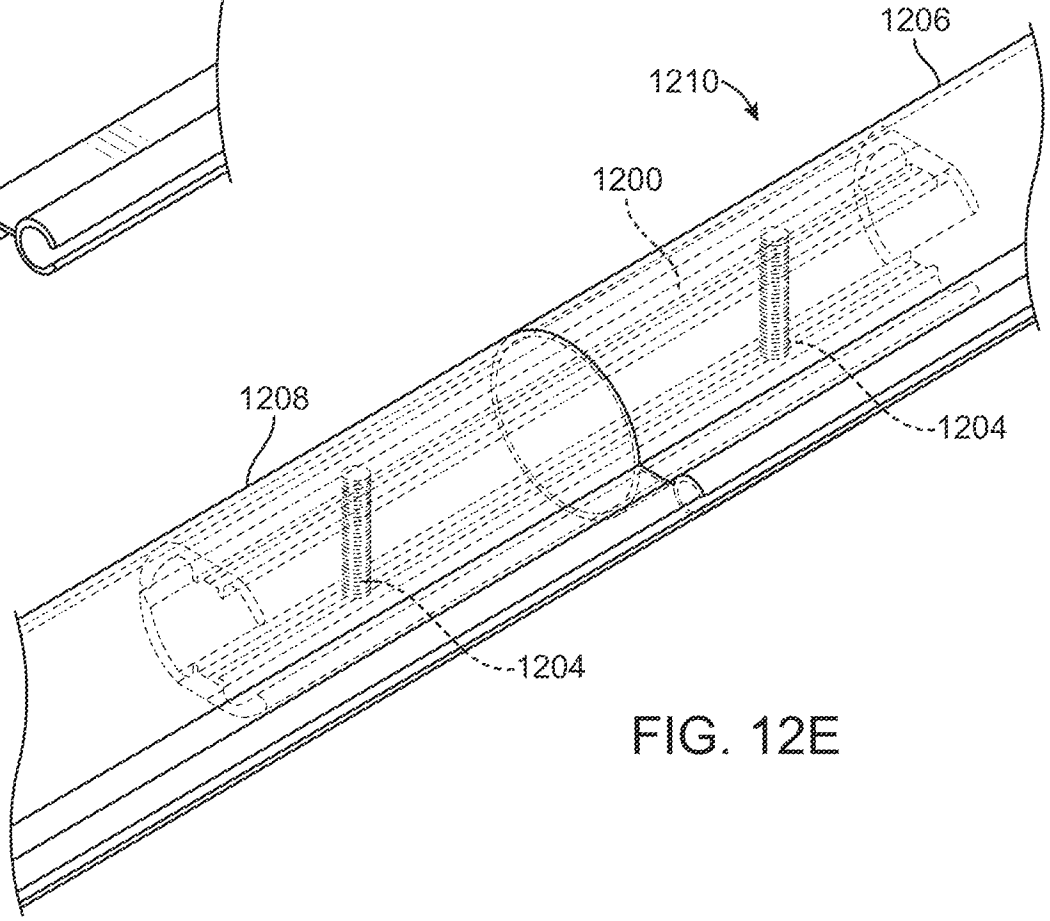
FIG. 12E is a front perspective view of the splice member of FIG. 12A coupled with a roller tube.
Figure 12D:
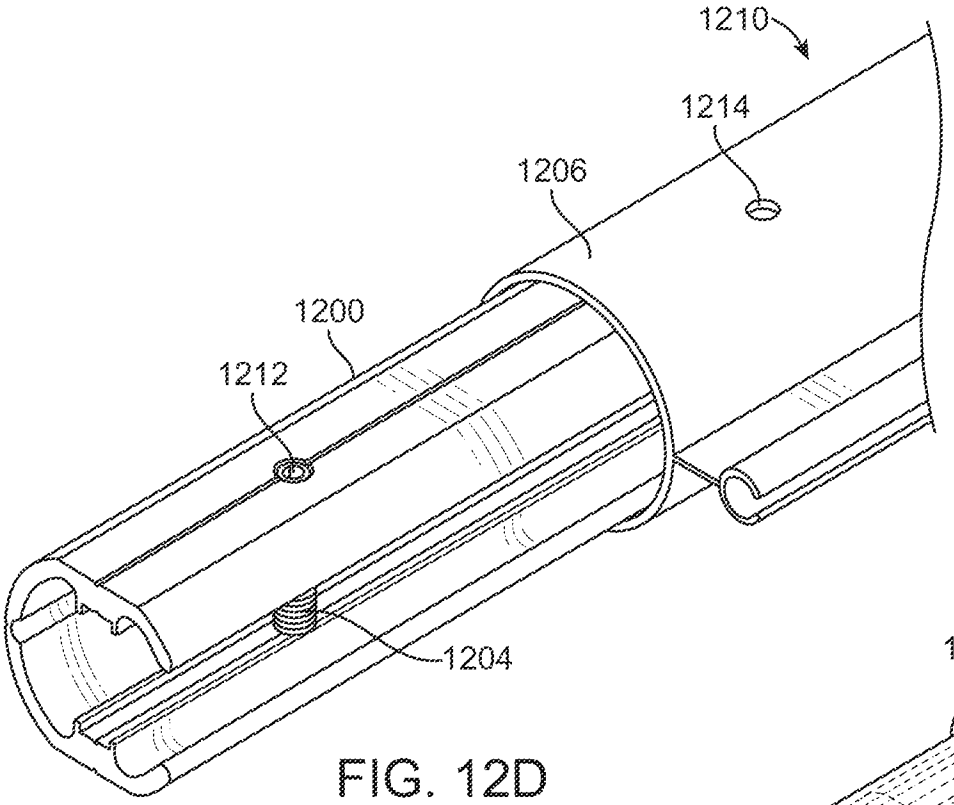
FIG. 12D is a front perspective view of the splice member of FIG. 12A partially coupled with a roller tube.

FIG. 12A depicts a front perspective view of the splice member 1200, FIG. 12B depicts a cross-sectional view of the splice member 1200 without the at least one fastener 1204, FIG. 12C depicts a cross-sectional view of the splice member 1200, FIG. 12D depicts a front perspective view of the splice member 1200 assembled with the a first portion 1206, and FIG. 12E depicts a front perspective view of the splice member 1200 assembled with the first portion 1206 and the second portion 1208.

In some embodiments, rotating the fastener 1204 may adjust the outer diameter A of the splice member 1200. At least one opening 1212 in the semi-circular body 1202 may provide rotational access to the at least one fastener 1204, e.g., allows for the at least one fastener 1204 to be rotated by inserting a screwdriver, an Allen wrench, or any other suitable device through the at least one opening 1212 to engage the at least one fastener 1204.

The splice member 1200 may be at least partially inserted into at least one of the first portion 1206 or the second portion 1208 of a rolling tube 1210. In some embodiments, the splice member 1200 is inserted into at least one of the first portion 1206 or the second portion 1208 so that the at least one opening 1212 is aligned with at least one opening 1214 in the rolling tube 1210. The at least one fastener 1204 is then rotated to expand the outer diameter A of the splice member 1200. Thus a compression fit is created between the at least one of the first portion 1206 or the second portion 1208.

In some embodiments, the first portion 1206 and the second portion 1208 may be coupled to one another using a compression fit by at least partially inserting the splice member 1200 into each of the first portion 1206 and the second portion 1208 so that openings 1212 in the splice member 1200 are aligned with openings 1214 in the rolling tube 1210. The outer diameter A is then expanded by rotating the fasteners 1204, and the splice member 1200 is secured within the first portion 1206 and the second portion 1208.

Figure 13A:
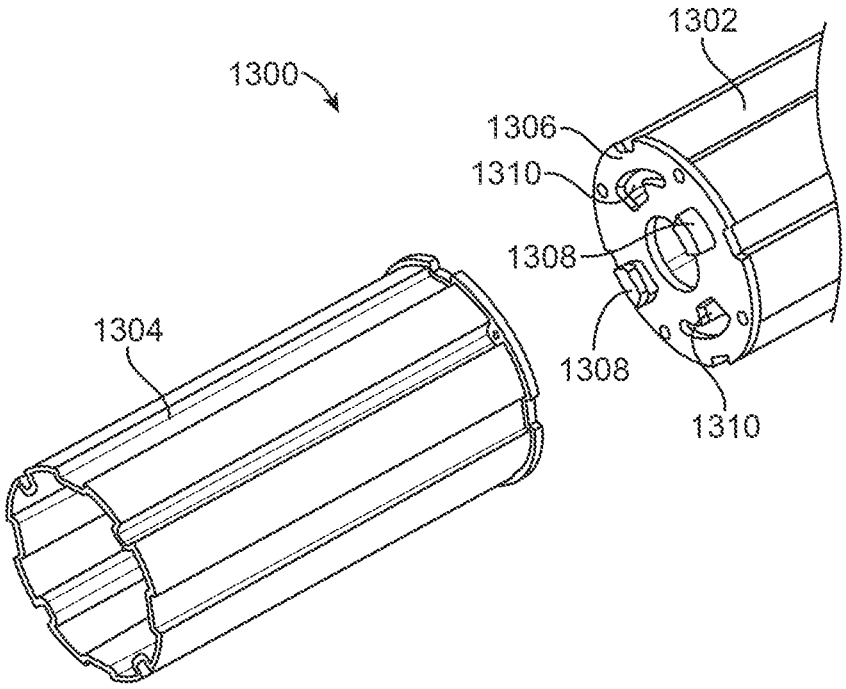
FIG. 13A is a front perspective view of a first portion and a second portion of a splice member according to certain embodiments of the present disclosure.
Figure 13B:
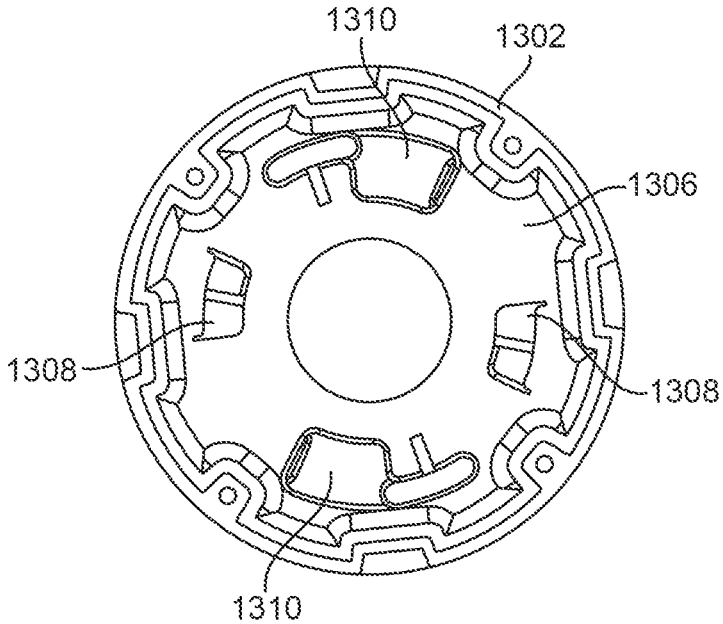
FIG. 13B is a side view of the first portion of the splice member of FIG. 13A.

According to certain embodiments, as shown in FIGS. 13A-13B, a splice member 1300 may include a first splice portion 1302 and a second splice portion 1304. The first splice portion 1302 may have an end 1306 that includes at least one protrusion 1308 and at least one key-hole recess 1310 that are sized and shaped to couple or lock to at least one protrusion and at least one recess on an end of an extrusion portion, e.g., a portion of a leading edge bar or a portion of a rolling tube.

The first splice portion 1302 may interlock with a first extrusion portion to couple the first splice portion 1302 to the first extrusion portion, and the second splice portion 1304 may interlock with a second extrusion portion to couple the second splice portion 1304 to the second extrusion portion. This coupling of the first splice portion 1302 to the first extrusion portion may be achieved by aligning the at least one key-hole recess 1310 of the first splice portion 1302 with the at least one protrusion of the first extrusion portion and rotating the first splice portion 1302 to lock the at least one protrusion of the first extrusion portion within the at least one key-hole recess 1310 of the first splice portion 1302. Similarly, the coupling of the second splice portion 1304 to the second extrusion portion may be achieved by aligning the at least one key-hole recess 1310 of the second splice portion 1304 with the at least one protrusion of the second extrusion portion and rotating the second splice portion 1304 to lock the at least one protrusion of the second extrusion portion within the at least one key-hole recess 1310 of the second splice portion 1304.

The interlocked first splice portion 1302 and the first extrusion portion may be coupled with the interlocked second splice portion 1304 and the second extrusion portion by inserting at least one protrusion 1308 of the first splice portion 1302 into at least one key-hole recess 1310 of the second splice portion 1304. Thus the first extrusion portion and the second extrusion portion may be coupled together via the first splice portion 1302 and the second splice portion 1304 to form a single extrusion member e.g., a leading edge bar or a rolling tube.

In some aspects of the present disclosure, elements of the pool cover assembly 108, including but not limited to encapsulation members 106, 200, 300, 400, 500, 600, 702, 802, 900, 1000, the corner connection assembly 700, 800, and splice members 916, 1008, 1106, 1200, 1300 may be used in pool assemblies that do not include an automatic pool cover and in some aspects that do not include any pool cover whatsoever.

In other words, while the encapsulation members 106, 200, 300, 400, 500, 600, 702, 802, 900, 1000, the corner connection assembly 700, 800, and the splice members 916, 1008, 1106, 1200, 1300 are disclosed herein relative to a "pool cover assembly," the present disclosure includes using encapsulation members, for example encapsulation members 106, 200, 300, 400, 500, 600, 702, 802, 900, 1000, to form up a pool that does not include a pool cover (for example a pool cover that moves along a track).

In such aspects, the encapsulation members may only include some of the features disclosed relative to encapsulation members 106, 200, 300, 400, 500, 600, 702, 802, 900, 1000, for example the encapsulation members may not include a cover track recess 206, 306, 406, 506, 606, 714, 814, 910, but may still include a coping portion 204, 304, 404, 710, 906. In such aspects, the encapsulation members may be used to form a coping around a pool that does not include a pool cover, and therefore does not require a cover track recess 206, 306, 406, 506, 606, 714, 814, 910 in the encapsulation members. In such aspects, the pool assembly may still include the corner connection assembly 700, 800 with the corner endcap member 704, 804, though the elements of the assembly may not include a cover track recess 206, 306, 406, 506, 606, 714, 814, 910 but may still include a coping portion 204, 304, 404, 710, 906. The encapsulation members of a pool assembly that does not include a pool cover thereby may still provide for forming a coping of the pool assembly and providing a recess for receiving a vinyl liner. Similarly, the corner endcap members and corner connection assembly may still be used to form up a pool corner of a pool assembly that does not include a pool cover.

Figure 14A:
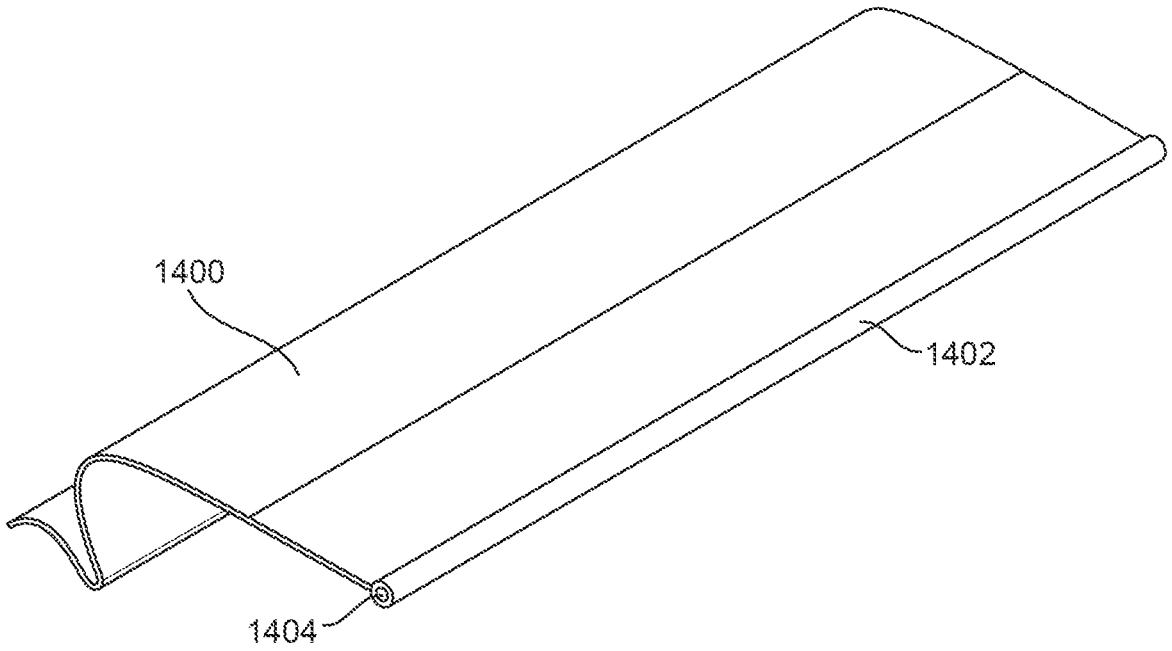
FIG. 14A is a front perspective view of a pool cover with a rope bead according to certain embodiments of the present disclosure.
Figure 14B:
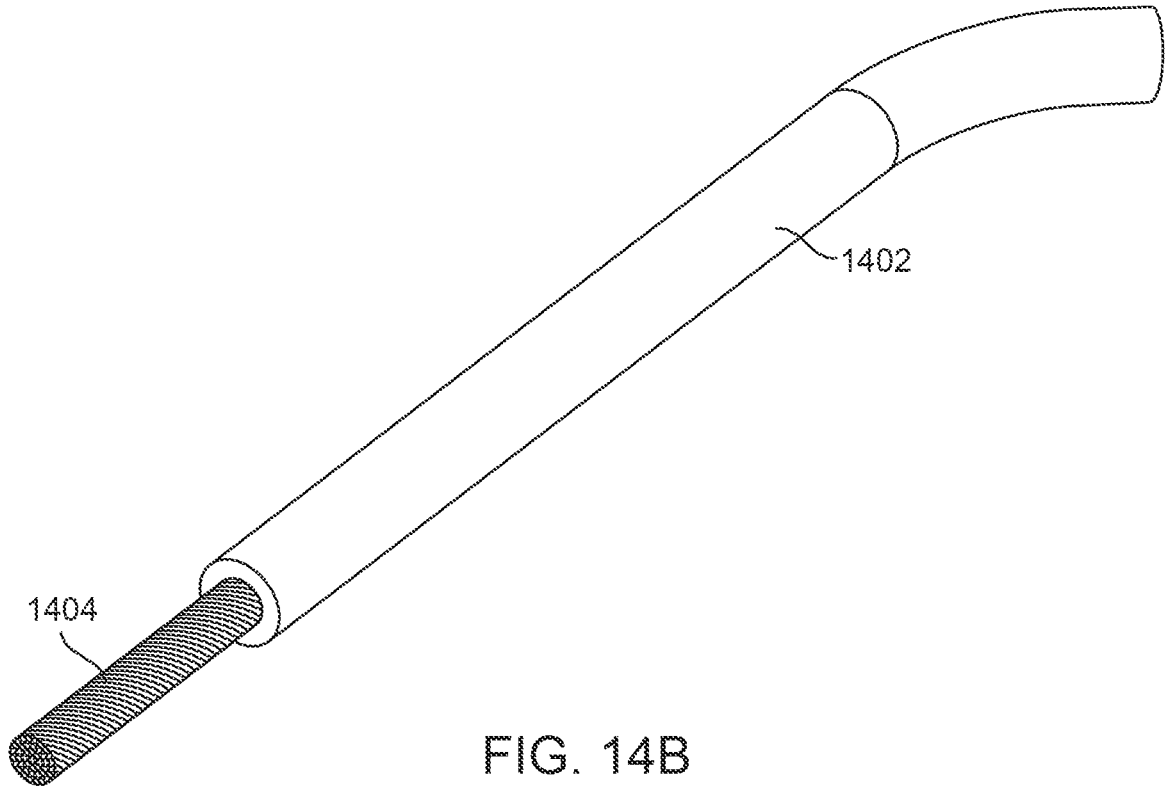
FIG. 14B is a front perspective view of the rope bead of FIG. 14A.

As discussed previously in relation to FIG. 1, an automated pool cover assembly may include a leading edge bar that is coupled to a pool cover, e.g., pool cover 1400 as shown in FIG. 14A. A rope bead, e.g., rope bead 1402 as shown in FIGS. 14A-14B, or other suitable feature may extend along a length of the fabric of the pool cover and may engage with the track to retain the pool cover above the water line of the pool. Electrical code requires any type of metal or conductive material around the pool be bonded together to create an equipotential grid. Thus, this requirement includes the leading edge bar that moves across the pool.

To create the equipotential grid, the leading edge bar may be bonded to a cable formed of a braided or stranded wire, e.g., wire 1404 as shown in FIGS. 14A-14B, that extends within the rope bead 1402 and along the length of the pool cover. The braided or stranded wire may be sewn or welded along the long edge of the pool cover and may terminate by bonding at the roller tube on one end and at the leading edge bar on the other. However, it can be difficult and costly to couple a wire along the length of the pool cover and bond it to the leading edge bar.

According to certain embodiments of the present disclosure, the braided bond wire used for grounding the leading edge bar may be combined with the rope bead that extends along the length of the pool cover. For example, the braided bond wire can be braided into the rope bead, can be used to form the rope bead, or can be positioned parallel with or wrapped helically around the rope bead. By combining the bonded wire with the rope bead, the combination bead and wire can be heat welded to the cover material. The heat welding can create an improved seal by providing two or more inches of cover material in which the combined bonded wire and rope bead may be secured to the edge of the pool cover as opposed to the inch and a half of space provided for heat welding the rope bead separate from the braided wire.

According to certain embodiments of the present disclosure, a non-conductive leading edge bar can be used in the pool cover assembly. For example, the leading edge bar 1100 discussed above with respect to FIGS. 11A-C may comprise a non-conductive material. Providing a leading edge bar made from a non-conductive material can eliminate the need to bond the leading edge bar to a wire extending along the length of the pool cover. Providing a leading edge bar that does not need to be grounded for electrical purposes can reduce the time required for manufacturing the pool cover system. In some embodiments, the leading edge bar may be manufactured from a polymer material, fiberglass pultrusion, glass or fiber reinforced polymer extrusions, polymer extrusions, ceramic materials and the like. In some embodiments, additional components of the pool cover assembly may be manufactured from these non-conductive materials including combinations of non-conductive materials, for example the roller tubes, encapsulation (including pieces of extrusion), and lids.

According to certain embodiments of the present disclosure, an automated pool cover assembly can include a rotary encoder system for determining the open or closed status of a pool cover. In some embodiments, the rotary encoder system may be a digital rotary encoder system while in other embodiments the rotary encoder system may be a mechanical (e.g. an electronic mechanical rotary encoder) rotary encoded system.

An automated pool cover can be collected on a roller tube when the pool cover is open. The rotary encoder system can determine how many rotations of the roller tube have occurred in a particular direction. The system can account for the roller tube rotating in a first direction to open the pool cover and rotating in a second opposite direction to close the pool cover. The rotary encoder system can determine the state of the automated pool cover based on the number of rotations of the roller tube in the first and the second directions.

The rotary encoder system can also control other pool features based on the status of the automated pool cover (i.e. open, closed, partially open, partially closed). For example, the rotary encoder system can prevent a water feature (e.g. a slide) from being turned on when the cover is determined to be in a closed position based on the rotation counts in a particular direction. In some embodiments, the rotary encoder system can determine a position of the cover along a length of the pool and may also determine which select pool features may be turned on or off. In some embodiments, a separate computing device may determine which pool features may be turned on or off in response to data received from the rotary encoder system.

According to certain embodiments of the present disclosure a pool cover, including but not limited to an automated pool cover, can include an edge member that is a webbing, for example but not limited to a polyester material (e.g. Dacron), Keder, woven or extruded polymer webbing, or other suitable material. The edge member may also be overmolded with a plastic bead. In some examples, the cover may include a plastic bead that is a single bead extending substantially along the length of the edge member. In some embodiments, multiple beads may be spaced along the length of the edge member (or cover). The bead(s) may include an extruded polymer webbing bead, a mechanically fastened bead, or a combination thereof. In some embodiments, the bead(s) may be coupled to the edge member in a variety ways including but not limited to sewing, mechanically fixing, overmolding, adhesively fixing, magnetically fixing, or any other suitable way. The webbing may then be welded or sewn to the edge of the cover in place of a rope hem. An edge of a pool cover formed in this way may be sturdier and may have a longer lifespan than covers comprising a rope hem.

In some examples, the edge member can include a piece of webbing that may include one or more beads molded onto the webbing, for example but not limited to a bead comprising a polymer material. The bead(s) can act similarly to a rope hem to hold the pool cover in place within a recess of the cover track so that the cover can extend horizontally along the length of the pool.

Different arrangements of the components depicted in the drawings or described above, as well as components and steps not shown or described are possible. Similarly, some features and sub-combinations are useful and may be employed without reference to other features and sub-combinations. Examples of the invention have been described for illustrative and not restrictive purposes, and alternative examples will become apparent to readers of this patent. Accordingly, the present invention is not limited to the examples described above or depicted in the drawings, and various examples and modifications may be made without departing from the scope of the claims below.

It should be noted that the systems and devices discussed above are intended merely to be examples. It must be stressed that various embodiments may omit, substitute, or add various procedures or components as appropriate. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

In the following, further examples are described to facilitate the understanding of the invention:

Example 1 is a pool cover assembly (which may incorporate features of any of the subsequent examples) comprising: a first encapsulation member defining a first side of a pool cover encapsulation, the first encapsulation member comprising a first mating feature; a second encapsulation member defining a second side of the pool cover encapsulation, the second encapsulation member comprising a second mating feature; and a corner endcap member comprising a third mating feature and a fourth mating feature, wherein the first encapsulation member is coupleable to the corner endcap member by the first mating feature and the third mating feature, wherein the second encapsulation member is coupleable to the corner endcap member by the second mating feature and the fourth mating feature, and wherein the corner endcap member couples with the first encapsulation member and the second encapsulation member to form a corner of the pool cover encapsulation.

Example 2 is the pool cover assembly of Example 1 or any of the preceding or subsequent examples, wherein the third mating feature of the corner endcap member comprises a plurality of protrusions and a plurality of recesses that correspond to a plurality of protrusions and a plurality of recesses of the first mating feature of the first encapsulation member, and the fourth mating feature of the corner endcap member comprises a plurality of protrusions and a plurality of recesses that correspond to a plurality of protrusions and a plurality of recesses of the second mating feature of the second encapsulation member.

Example 3 is the pool cover assembly of Example 1 or any of the preceding or subsequent examples, wherein the first encapsulation member comprises a first coping portion, and the second encapsulation member comprises a second coping portion.

Example 4 is the pool cover assembly of Example 3 or any of the preceding or subsequent examples, further comprising a corner coping clip comprising at least one lip, wherein the at least one lip is coupleable with at least one protrusion of the first coping portion and at least one protrusion of the second coping portion so that the corner coping clip is securable to the first coping portion and the second coping portion at the corner.

Example 5 is the pool cover assembly of Example 1 or any of the preceding or subsequent examples, wherein the corner is a 90 degree corner.

Example 6 is the pool cover assembly of Example 1 or any of the preceding or subsequent examples, wherein each of the first mating feature and the second mating feature comprise at least one snap-button that assists with coupling the corner endcap member with the first encapsulation member and the second encapsulation member.

Example 7 is the pool cover assembly of Example 1 or any of the preceding or subsequent examples, further comprising a liner corner plate friction fit within a liner track of each of the first encapsulation member and the second encapsulation member at the corner.

Example 8 is the pool cover assembly of Example 1 or any of the preceding or subsequent examples, wherein the first encapsulation member comprises a first encapsulation portion that is removably coupleable to a second encapsulation portion, and the first encapsulation portion and the second encapsulation portion are securable to each other via a splice member.

Example 9 is the pool cover assembly of Example 8 or any of the preceding or subsequent examples, wherein the splice member comprises at least one of a coping clip, a snap-button that is engageable with an opening in each of the first encapsulation portion and the second encapsulation portion, or a compression fit fastener that adjusts an outer diameter of the splice member.

Example 10 is the pool cover assembly of Example 1 or any of the preceding or subsequent examples, further comprising at least one of a rolling tube formed from a first rolling tube portion and a second rolling tube portion coupled together via a splice member or a leading edge bar formed from a first leading edge portion and a second leading edge portion coupled together via the splice member.

Example 11 is a pool cover assembly (which may incorporate features of any of the preceding or subsequent examples) comprising: an encapsulation member comprising a first encapsulation portion that is removably coupleable to a second encapsulation portion, wherein the first encapsulation portion and the second encapsulation portion are securable to each other via a splice member.

Example 12 is the pool cover assembly of Example 11 or any of the preceding or subsequent examples, wherein the splice member comprises at least two snap-buttons, wherein a first snap-button is engageable with an opening in the first encapsulation portion upon insertion of the splice member into the first encapsulation portion and a second snap-button is engageable with an opening in the second encapsulation portion upon insertion of the splice member into the second encapsulation portion.

Example 13 is the pool cover assembly of Example 11 or any of the preceding or subsequent examples, wherein the splice member comprises a fastener coupled to opposite sides of the splice member and extending through an interior of the splice member, wherein an outer diameter of the splice member is adjustable using the fastener.

Example 14 is the pool cover assembly of Example 11 or any of the preceding or subsequent examples, wherein the splice member comprises a coping clip that slide fits onto a coping of the first encapsulation portion and the second encapsulation portion to cover a joint between the first encapsulation portion and the second encapsulation portion.

Example 15 is the pool cover assembly of Example 11 or any of the preceding or subsequent examples, further comprising: a second encapsulation member comprising a third encapsulation portion that is removably coupleable to a fourth encapsulation portion; and a corner endcap member comprising a first mating feature and second mating feature, wherein the first encapsulation portion comprises a third mating feature and the third encapsulation portion comprises a fourth mating feature, and wherein the first encapsulation portion is coupleable to the corner endcap member by the first mating feature and the third mating feature, and the third encapsulation portion is coupleable to the corner endcap member by the second mating feature and the fourth mating feature.

Example 16 is a method (which may incorporate features of any of the preceding or subsequent examples) of assembling a corner of a pool cover assembly, the method comprising: coupling a first mating feature of a first encapsulation member with a third mating feature of a corner endcap member to form a first side of a corner of a pool cover assembly; and coupling a second mating feature of a second encapsulation member with fourth mating feature of the corner endcap member to form a second side of the corner of the pool cover assembly.

Example 17 is the method of Example 16 or any of the preceding or subsequent examples, wherein the third mating feature of the corner endcap member comprises a plurality of protrusions and a plurality of recesses and the first mating feature of the first encapsulation member comprises a plurality of protrusions and a plurality of recesses, wherein coupling the first mating feature with the third mating feature comprises inserting the plurality of protrusions of the corner endcap member into the plurality of recesses of the first encapsulation member and inserting the plurality of protrusions of the first encapsulation member into the plurality of recesses of the corner endcap member.

Example 18 is the method of Example 16 or any of the preceding or subsequent examples, wherein the fourth mating feature of the corner endcap member comprises a plurality of protrusions and a plurality of recesses and the second mating feature of the second encapsulation member comprises a plurality of protrusions and a plurality of recesses, wherein coupling the second mating feature with the fourth mating feature comprises inserting the plurality of protrusions of the corner endcap member into the plurality of recesses of the second encapsulation member and inserting the plurality of protrusions of the second encapsulation member into the plurality of recesses of the corner endcap member.

Example 19 is the method of Example 16 or any of the preceding or subsequent examples, further comprising inserting a liner corner plate within a liner track of each of the first encapsulation member and the second encapsulation member at the corner, wherein the liner corner plate is friction fit within the liner track.

Example 20 is the method of Example 16 or any of the preceding or subsequent examples, wherein the first encapsulation member comprises a first encapsulation portion that is removably coupleable to a second encapsulation portion, wherein the method further comprises securing the first encapsulation portion and the second encapsulation portion to each other via a splice member.

That which is claimed is:

1. A pool encapsulation assembly comprising:

a first encapsulation member defining a first side of a pool encapsulation, the first encapsulation member comprising a first mating feature comprising a first splice recess;

a second encapsulation member defining a second side of the pool encapsulation, the second encapsulation member comprising a second mating feature; and a corner endcap member comprising a third mating feature and a fourth mating feature, wherein the first encapsulation member is coupleable to the corner endcap member by engagement between the first mating feature and the third mating feature;

wherein the second encapsulation member is coupleable to the corner endcap member by engagement between the second mating feature and the fourth mating feature;

wherein the corner endcap member is coupleable to the first encapsulation member and the second encapsulation member to form a corner of the pool encapsulation; and wherein the first encapsulation member comprises a first encapsulation portion that is removably coupleable to a second encapsulation portion, the first encapsulation portion comprises a first portion of the first splice recess, the second encapsulation portion comprises a second portion of the first splice recess, and the first encapsulation portion and the second encapsulation portion are securable to each other via a splice member arranged at least partially in the first portion and the second portion of the first splice recess.

2. The pool encapsulation assembly of claim 1, wherein:

the first mating feature further comprises first protrusion extending from a wall of the first splice recess, and the third mating feature comprises a first track sized and shaped to extend within the first splice recess below the first protrusion.

3. The pool encapsulation assembly of claim 2, wherein the corner endcap member further comprises a fifth mating feature comprising (i) a first projection and (ii) a second projection, wherein the second projection comprises a recess formed therein, and wherein the first encapsulation member further comprises a sixth mating feature comprising (i) a second splice recess sized and shaped to receive the first projection of the corner endcap member and (ii) a second protrusion sized and shaped to be received in the recess of the second projection.

4. The pool encapsulation assembly of claim 3, wherein the first mating feature further comprises one of an opening or a snap button and the third mating feature includes the other of the opening or the snap button, wherein the snap button is sized and shaped to extend through the opening.

5. The pool encapsulation assembly of claim 3, wherein the first projection of the fifth mating feature is substantially perpendicular to the second projection of the fifth mating feature.

6. The pool encapsulation assembly of claim 3, wherein the corner endcap member further comprises a seventh mating feature comprising an additional recess extending between the second projection of the fifth mating feature and a wall of the first track, wherein the additional recess is sized and shaped to receive a portion of the first encapsulation member.

7. The pool encapsulation assembly of claim 6, wherein the additional recess of the corner endcap member is sized and shaped to receive the first protrusion of the first mating feature of the first encapsulation member.

8. The pool encapsulation assembly of claim 1, wherein the splice member comprises a coping clip.

9. The pool encapsulation assembly of claim 1, wherein the splice member comprises a snap-button that is engageable with an opening in each of the first encapsulation portion and the second encapsulation portion.

10. The pool encapsulation assembly of claim 1, wherein the splice member comprises a compression fit fastener that adjusts an outer diameter of the splice member.

11. A pool encapsulation assembly comprising:

a splice member; and an encapsulation member comprising a first encapsulation portion that is removably coupleable to a second encapsulation portion, wherein each of the first encapsulation portion and the second encapsulation portion comprises:

a cover track recess; and at least one splice recess, wherein the cover track recess and the at least one splice recess share an adjoining wall portion;

wherein the first encapsulation portion and the second encapsulation portion are securable to each other via the splice member such that the first encapsulation portion and the second encapsulation portion are longitudinally aligned; and wherein the splice member is at least partially arranged in the at least one splice recess of the first encapsulation portion and the second encapsulation portion and abuts an interior surface of the at least one splice recess of the first encapsulation portion and the second encapsulation portion.

12. The pool encapsulation assembly of claim 11, wherein at least one wall of each of the at least one splice recess extends from at least one wall of the respective cover track recess.

13. The pool encapsulation assembly of claim 11, wherein the splice member comprises a fastener coupled to opposite sides of the splice member and extending through an interior of the splice member.

14. The pool encapsulation assembly of claim 11, wherein the splice member comprises a snap-button that is engageable with an opening in each of the first encapsulation portion and the second encapsulation portion.

15. The pool encapsulation assembly of claim 11, further comprising:

a second encapsulation member comprising a third encapsulation portion that is removably coupleable to a fourth encapsulation portion; and a corner endcap member comprising a first mating feature and second mating feature;

wherein the first encapsulation portion comprises a third mating feature and the third encapsulation portion comprises a fourth mating feature; and wherein the first encapsulation portion is coupleable to the corner endcap member by the first mating feature and the third mating feature, and the third encapsulation portion is coupleable to the corner endcap member by the second mating feature and the fourth mating feature.

16. A method of assembling a corner of a pool encapsulation assembly, the method comprising:

coupling a first mating feature of a first encapsulation member with a third mating feature of a corner endcap member to form a first side of the corner of the pool encapsulation assembly, wherein the first mating feature comprises a first splice recess;

coupling a second mating feature of a second encapsulation member with a fourth mating feature of the corner endcap member to form a second side of the corner of the pool encapsulation assembly; and coupling a first encapsulation portion of the first encapsulation member with a second encapsulation portion of the first encapsulation member via a splice member, wherein the first encapsulation portion comprises a first portion of the first splice recess, the second encapsulation portion comprises a second portion of the first splice recess, and the splice member is arranged at least partially in the first portion and the second portion of the first splice recess.

17. The method of claim 16, wherein the step of coupling the first mating feature of the first encapsulation member with the third mating feature of the corner endcap member to form the first side of the corner of the pool encapsulation assembly further comprises positioning a first track of the third mating feature within the first splice recess of the first mating feature, wherein the first track is secured in place in part by a first protrusion extending from a wall of the first splice recess.

18. The method of claim 17, wherein the step of coupling the first mating feature of the first encapsulation member with the third mating feature of the corner endcap member to form the first side of the corner of the pool encapsulation assembly further comprises securing the first mating feature to the third mating feature via at least one of a coping clip, a snap-button, or a compression fit fastener.

19. The method of claim 17, further comprising:

coupling a fifth mating feature of the corner endcap member with a sixth mating feature of the first encapsulation member, wherein the fifth mating feature comprises (i) a first projection and (ii) a second projection including a recess formed therein, and wherein the sixth mating feature of the first encapsulation member comprises (i) a second splice recess sized and shaped to receive the first projection of the corner endcap member and (ii) a second protrusion sized and shaped to be received in the recess of the second projection.

20. The method of claim 19, wherein the first projection of the fifth mating feature is substantially perpendicular to the second projection of the fifth mating feature.

21. A pool encapsulation assembly comprising:

a pool edge encapsulation member comprising a first encapsulation portion that is removably coupleable to a second encapsulation portion, wherein each of the first encapsulation portion and the second encapsulation portion comprise:

a horizontally oriented recess; and a vertically oriented splice recess positioned on a backside of the horizontally oriented recess;

wherein the first encapsulation portion and the second encapsulation portion are securable to each other via a splice member such that the first encapsulation portion and the second encapsulation portion are longitudinally aligned; and wherein each of the vertically oriented splice recesses of the first encapsulation portion and the second encapsulation portion is sized to receive at least a portion of the splice member.

22. The pool encapsulation assembly of claim 21, wherein the horizontally oriented recess is a cover track recess.

23. The pool encapsulation assembly of claim 21, wherein the horizontally oriented recess comprises a sideways facing opening, wherein the vertically oriented splice recess comprises an upwards facing opening.

24. The pool encapsulation assembly of claim 23, wherein the splice member comprises a plurality of mating features engageable with the first and second encapsulation portions.

25. The pool encapsulation assembly of claim 24, wherein the mating features comprise protrusions extending from the splice member engageable with openings in a wall of the vertically oriented splice recess.

26. The pool encapsulation assembly of claim 23, wherein the horizontally oriented recess comprises a protrusion extending into an interior of the horizontally oriented recess.

27. The pool encapsulation assembly of claim 23, wherein the first and second encapsulation portions each further comprise a coping portion extending upwardly from the horizontally oriented recess.

28. The pool encapsulation assembly of claim 27, wherein the coping portion extends upwardly from the sideways facing opening of the horizontally oriented recess.

29. The pool encapsulation assembly of claim 28, wherein the vertically oriented splice recess is located below the coping portion.

30. The pool encapsulation assembly of claim 27, wherein the coping portion is configured to define a perimeter edge of a pool.

31. The pool encapsulation assembly of claim 30, wherein a backside of the coping portion comprises an additional recess.

32. The pool encapsulation assembly of claim 27, wherein the first and second encapsulation portions each further comprise an additional recess positioned below the horizontally oriented recess.

33. The pool encapsulation assembly of claim 32, wherein the additional recess comprises an additional splice recess.

* * * * *